US010989053B2

(12) United States Patent
Fenton

(10) Patent No.: US 10,989,053 B2
(45) Date of Patent: Apr. 27, 2021

(54) ROTICULATING THERMODYNAMIC APPARATUS

(71) Applicant: FeTu Limited, Elland (GB)

(72) Inventor: Jonathan Fenton, Bradford (GB)

(73) Assignee: FETU LIMITED, Elland (GB)

( * ) Notice: Subject to any disclaimer, the term of this patent is extended or adjusted under 35 U.S.C. 154(b) by 0 days.

(21) Appl. No.: 16/975,755

(22) PCT Filed: Feb. 15, 2019

(86) PCT No.: PCT/GB2019/050401
§ 371 (c)(1),
(2) Date: Aug. 26, 2020

(87) PCT Pub. No.: WO2019/166768
PCT Pub. Date: Sep. 6, 2019

(65) Prior Publication Data

US 2020/0400023 A1 Dec. 24, 2020

(30) Foreign Application Priority Data

Feb. 27, 2018 (GB) ..... 1803181

(51) Int. Cl.
*F01C 21/08* (2006.01)
*F01C 11/00* (2006.01)
(Continued)

(52) U.S. Cl.
CPC ..... *F01C 21/08* (2013.01); *F01C 9/005* (2013.01); *F01C 11/002* (2013.01); *F01C 21/008* (2013.01); *F01C 21/02* (2013.01)

(58) Field of Classification Search
CPC ..... F01C 21/08; F01C 9/005; F01C 21/008; F01C 11/002; F01C 21/02
(Continued)

(56) References Cited

U.S. PATENT DOCUMENTS 826,985 A * 7/1906 Appel ..... F01C 9/005 418/68
1,904,373 A * 4/1933 Kempthorne ..... F01C 9/005 418/68
(Continued)

FOREIGN PATENT DOCUMENTS

CN 1061646 A 6/1992
FR 2906562 A1 * 4/2008 ..... F01C 3/06
(Continued)

*Primary Examiner* — J. Todd Newton
(74) *Attorney, Agent, or Firm* — Coats & Bennett, PLLC

(57) ABSTRACT

An apparatus comprising: a shaft (18) rotatable about a first rotational axis (30); an axle (20) defining a second rotational axis (32); a first piston member (22) extending from the axle (20) towards a distal end of the shaft (18); a rotor (16) carried on the axle (20); the rotor (16) comprising a first chamber (34*a*); a housing (12) having a wall defining a cavity (26); a first magnetic guide feature (52); a second magnetic guide feature (50); whereby: the rotor (16) and axle (20) are rotatable with the shaft (18) around the first rotational axis (30); the rotor (16) is pivotable about the axle (20) to permit relative pivoting motion between the rotor (16) and the first piston member (22) as the rotor rotates about the first rotational axis (30); and at least one of the first magnetic guide feature (52) and second magnetic guide feature (50) comprises an electromagnet to pivot the rotor (16) about the axle (20) relative to the first piston member (22).

29 Claims, 13 Drawing Sheets

(51) Int. Cl.
*F01C 21/00* (2006.01)
*F01C 9/00* (2006.01)
*F01C 21/02* (2006.01)

(58) Field of Classification Search
USPC ..... 418/68, 140, 187, 61.1, 215; 123/18 A, 123/18 R, 43 A, 45 A, 200–249; 60/39.55
See application file for complete search history.

(56) References Cited

U.S. PATENT DOCUMENTS 1,967,167 A * 7/1934 Weis ..... F04C 3/06 418/68
2,043,544 A * 6/1936 Kempthorne ..... F01C 3/06 417/405
2,173,663 A * 9/1939 Raymond ..... F02B 53/00 123/241
3,973,469 A * 8/1976 Humen ..... F01C 3/06 91/51
4,021,158 A * 5/1977 Bajulaz ..... F01C 9/005 418/52
4,024,841 A * 5/1977 Smith ..... F01C 1/00 123/241
4,371,320 A * 2/1983 Sacchi ..... F04C 9/005 417/461
5,147,193 A * 9/1992 Larsen ..... F01C 3/06 418/68
5,171,142 A * 12/1992 Proglyada ..... F01C 9/005 418/68
5,199,864 A * 4/1993 Stecklein ..... F01C 3/06 418/53
5,410,944 A * 5/1995 Cushman ..... B25J 9/14 74/490.05
5,993,182 A * 11/1999 Beldy ..... F01C 9/002 418/68
6,241,493 B1 * 6/2001 Turner ..... F01C 3/06 418/1
6,325,038 B1 * 12/2001 Millett ..... F01C 9/005 123/241
7,214,045 B2 * 5/2007 Turner ..... F01C 3/06 418/1
7,469,673 B2 * 12/2008 Wagner ..... F01C 9/005 123/241
7,670,121 B2 3/2010 Weatherbee
9,151,220 B2 * 10/2015 Oledzki ..... F02B 53/02
10,323,517 B2 * 6/2019 Welker ..... F01C 21/08
10,443,383 B2 * 10/2019 Fenton ..... F01C 9/005
2001/0010801 A1 * 8/2001 Turner ..... F01C 20/18 418/68
2002/0112485 A1 8/2002 Kasmer
2005/0186100 A1 * 8/2005 Weatherbee ..... F01C 9/005 418/16
2018/0076690 A1 * 3/2018 Robertson ..... F02B 55/08
2019/0097513 A1 * 3/2019 Kim ..... H02K 41/03
2020/0328667 A1 * 10/2020 Dai ..... H02K 13/003
2020/0343804 A1 * 10/2020 Mahajan ..... H02K 41/065

FOREIGN PATENT DOCUMENTS

GB 2544819 A 5/2017
JP 2001355401 A 12/2001
WO WO-2009127791 A1 * 10/2009 ..... F01C 9/005
WO WO-2010040919 A1 * 4/2010 ..... F04C 15/008
WO 2017089740 A1 6/2017
WO WO-2017089740 A1 * 6/2017 ..... F01C 21/08

* cited by examiner

ROTICULATING THERMODYNAMIC APPARATUS

The present disclosure relates to a roticulating thermodynamic apparatus.

In particular the disclosure is concerned with a thermodynamic apparatus operable as a heat pump and/or heat engine.

BACKGROUND

Conventional heat pumps and heat engines that compress and expand a working fluid often comprise a pump to pressurise the working fluid and a turbine to expand the fluid. This is because the most efficient conventional thermodynamic expanders tend to be of a rotational type (e.g. turbines) and are typically limited to a single stage expansion ratio of 3:1.

In order to optimise performance of the system, the running speed of the turbine is generally higher than the running speed of the pump. Hence the pump and turbine tend to be of different types and rotate independently of one another to allow them to run at different speeds.

Additionally, conventional pump and turbine arrangements require consistent running speeds in order to maximise their efficiency. The very nature of most systems means they tend to be optimised for a relatively narrow operating range, and running outside of this range may result in high inefficiencies or unacceptable wear on components.

This means that for a conventional heat pump or conventional heat engine a large differential in temperature is required to achieve sufficiently high running speeds, which means such devices cannot operate in environments where only lower temperature differentials are available. This limits the effectiveness of such conventional devices.

Hence a heat pump or motor which may operate over a wide range of running speeds and/or temperature differentials with fewer limitations, fewer losses and of higher efficiency is highly desirable.

SUMMARY

According to the present disclosure there is provided an apparatus and method as set forth in the appended claims. Other features of the invention will be apparent from the dependent claims, and the description which follows.

Accordingly there may be provided an apparatus comprising: a shaft (18) which defines and is rotatable about a first rotational axis (30); an axle (20) defining a second rotational axis (32), the shaft (18) extending through the axle (20); a first piston member (22) provided on the shaft (18), the first piston member (22) extending from the axle (20) towards a distal end of the shaft (18); a rotor (16) carried on the axle (20); the rotor (16) comprising a first chamber (34*a*), the first piston member (22) extending across the first chamber (34*a*); a housing (12) having a wall (24) which defines a cavity (26), the rotor (16) being rotatable and pivotable within the cavity (26); a first magnetic guide feature (52) coupled to the rotor (16); a second magnetic guide feature (50) coupled to the housing (12); whereby: the rotor (16) and axle (20) are rotatable with the shaft (18) around the first rotational axis (30); the rotor (16) is pivotable about the axle (20) about the second rotational axis (32) to permit relative pivoting motion between the rotor (16) and the first piston member (22) as the rotor (16) rotates about the first rotational axis (30); and at least one of the first magnetic guide feature (52) and second magnetic guide feature (50) comprises an electro-magnet operable to magnetically couple to the other of the first magnetic guide feature (52) and second magnetic guide feature (50) to pivot the rotor (16) thereby inducing the rotor (16) to pivot about the axle (20) relative to the first piston member (22).

In one example the first chamber (34*a*) has a first opening (36); and the first piston member (22) extends from the axle (20) across the first chamber (34*a*) towards the first opening (36).

In one example, the first piston member (22) extends from one side of the axle (20) along the shaft (18); and a second piston member (22) extends from the other side of the axle (20) along the shaft (18), the rotor (16) comprising a second chamber (34*b*) to permit relative pivoting motion between the rotor (16) and the second piston member (22) as the rotor (16) rotates about the first rotational axis (30).

In one example, the second chamber (34*b*) has a second opening (36); and the second piston member (22) extends from the axle (20) across the second chamber (34*b*) towards the second opening (36).

In one example, the shaft (18), axle (20) and piston member(s) (22) are fixed relative to one another.

In one example, the magnetically coupling between the first magnetic guide feature (52) and second magnetic guide feature (50) drives the rotation of the shaft (18) about the first rotational axis (30).

In one example, the first magnetic guide feature (52) comprises at least one permanent magnet.

In one example, the first magnetic guide feature (52) comprises two diametrically opposed permanent magnets arranged on the rotor (16).

In one example, the first magnetic guide feature comprises one or more clusters of permanent magnets arranged on the rotor.

In one example, the first magnetic guide feature (52) is configured to be received in one or more recesses (53) in the rotor (16).

In one example, the first magnetic guide feature (52) comprises: a slewing ring; and a plurality of permanent magnets arranged on an outside of the slewing ring, wherein the slewing ring is configured to be coupled to the rotor via an engagement fixture.

In one example, the engagement fixture comprises a pivot pin to enable the first magnetic guide feature (52) to pivot relative to the rotor (16).

In one example, the second magnetic guide feature (50) comprises a plurality of electro-magnets.

In one example, the second magnetic guide feature (50) comprises a spacer ring and the plurality of electro-magnets are arranged on an inside surface of the spacer ring.

In one example, the plurality of electro-magnets are arranged in an array on the inside of the housing.

In one example, the apparatus comprises a controller to control the polarity of the plurality of electro-magnets of the second magnetic guide feature (50).

In one example, the magnetic coupling of the second magnetic guide feature (50) and the first magnetic guide feature (52) is configured to provide a guide path around a first circumference of the rotor (16) or housing (12).

In one example, the guide path comprises at least: a first inflexion which directs the guide path away from a first side of the first circumference and then back toward a second side of the first circumference; and a second inflexion which directs the guide path away from the second side of the first circumference and then back toward the first side of the first circumference.

In one example, there is provided a first fluid flow section (111); a first port (114*a*) and second port (114*b*) provided in a wall of the housing and each in flow communication with the first chamber (134*a*); and a second fluid flow section (115) comprising: a second chamber (134*b*, 234*b*), a second housing wall adjacent the second chamber (134*b*, 234*b*), a third port (116*a*) and a fourth port (116*b*) provided in the second housing wall and each in flow communication with the second chamber (134*b*, 234*b*), such that the second fluid flow section (115) is configured for the passage of fluid between the third port (116*a*) and fourth port (116*b*) via the second chamber (134, 234*b*); the second port (114*b*) being in fluid communication with the third port (116*a*) via a first heat exchanger (302*a*).

In one example, the first rotor (119) comprises the second chamber (134*b*); the first piston member (122*a*) extends from one side of the first axle (120) along the first shaft portion (118); and a second piston member (122*b*) extends from the other side of the first axle (120) along the first shaft portion (118), across the second chamber (134*b*) to permit the first rotor (119) to pivot relative to the second piston member (122*b*) as the first rotor (119) rotates about the first rotational axis (130); and the fourth port (116*b*) is in fluid communication with the first port (114*a*) via a second heat exchanger (306*a*).

In one example, the apparatus also includes a second rotor (219) comprising the second chamber (234*b*), a second shaft portion (218) rotatable about the first rotational axis (130); and the second shaft portion (218) is coupled to the first shaft portion (118) such that the first shaft portion (118) and second shaft portion (218) are rotatable together around the first rotational axis (130); a second axle (220) defining a third rotational axis (232), the second shaft portion (218) extending through the second axle (220); a second piston member (222*b*) provided on the second shaft portion (218), the second piston member (222*b*) extending from the second axle (220) towards a distal end of the second shaft portion (218); the second rotor (219) carried on the second axle (220); the second piston member (222*b*) extending across the second chamber (234*b*); whereby: the second rotor (219) and second axle (220) are rotatable with the second shaft portion (218) around the first rotational axis (130); and the second rotor (219) is pivotable about the second axle (220) about the third rotational axis (232) to permit the second rotor (219) to pivot relative to the second piston member (222) as the second rotor (219) rotates about the second rotational axis (130).

In one example, the first rotor (119) comprises: a first rotor second chamber (134*b*), the first piston member (122*a*) extending from one side of the first axle (120) along the first shaft portion (118); and a second piston member (122*b*) extends from the other side of the first axle (120) along the first shaft portion (118), across the first rotor second chamber (134*b*) to permit the first rotor (119) to pivot relative to the second piston member (122*b*) as the first rotor (119) rotates about the first rotational axis (130); and the second rotor (219) comprises: a second rotor first chamber (234*a*) the second piston member (222*b*) extends from one side of the second axle (220) along the second shaft portion (218); and a second rotor first piston member (222*a*) extends from the other side of the second axle (220) along the second shaft portion (218), across the second rotor first chamber (234*a*) to permit the second rotor (219) to pivot relative to the second rotor first piston member (222*a*) as the second rotor (219) rotates about the first rotational axis (130); wherein: the first rotor second chamber (134*b*) is in flow communication with: a fifth port (114*c*) and a sixth port (114*d*); to thereby form part of the first fluid flow section (111), and configured for the passage of fluid between the fifth port (114*c*) and sixth port (114*d*) via the first rotor second chamber (134*b*); the second rotor first chamber (234*a*) is in flow communication with a seventh port (116*c*) and an eighth port (116*d*); to thereby form part of the second fluid flow section (115), and configured for the passage of fluid between the seventh port (116*c*) and eighth port (116*d*) via the second rotor second chamber (234*b*); wherein the sixth port (114*d*) is in fluid communication with the seventh port (116*c*) via the first heat exchanger (302*a*).

In one example, the eight port (116*d*) is in fluid communication with the fifth port (114*c*) via a second heat exchanger (306*a*).

In one example, the fourth port (116*b*) is in fluid communication with the first port (114*a*) via the second heat exchanger (306*a*).

In one example, the first heat exchanger (302*a*) is operable as a heat sink to remove heat energy from fluid passing through it.

In one example, the first heat exchanger (302*a*) is operable as a heat source to add heat energy to fluid passing through it.

In one example, the heat source comprises a substance passing through a duct (303) in the first heat exchanger (302*a*), wherein the apparatus (1000) provides cooling to the substance.

In one example, the fluid comprises air.

In one example, the apparatus comprises a motor (308) coupled to the first shaft portion (118) configured to drive the rotor (119) around the first rotational axis (130).

In one example, the magnetic coupling between the first magnetic guide feature and the second magnetic guide feature is operable to rotate the first shaft portion in a either a first direction or a second direction such that when the magnetic coupling is configured to drive the rotor (119) around the first rotational axis (130) in a first direction, the first heat exchanger (302*a*) is operable to act as a heat source to transfer heat from the substance to the fluid, and wherein when the magnetic coupling is configured to drive the rotor (119) around the first rotational axis (130) in a second direction, opposite to the first direction, the first heat exchanger (302*a*) is operable to act as a heat sink to transfer heat from the fluid to the substance.

Hence there may be provided an apparatus operable to displace and expand fluid which may be configured as heat pump to remove heat from a system (e.g. a refrigerator) or configured as a heat engine to extract work from a working fluid in order to provide a rotational output.

The displacement section (e.g. pump) and expansion section (e.g. turbine) of the present device can sustain their optimal efficiency at near identical speeds and be subject to a single set of mechanical constraints by virtue of being housed within a common device. Hence arrangements of the present disclosure may be substantially thermodynamically ideal.

The apparatus may comprise a core element having linked displacement and expansion chambers which are defined by walls of a single common rotor. The rotor is pivotable relative to a rotatable piston. Hence this arrangement provides a positive displacement system which is operable and effective at lower rotational speed than examples of the related art. The system is also operable up to and including speeds equivalent to examples of the related art.

The core elements may be described as a 'roticulator' since the rotor of the present disclosure is operable to simultaneously 'rotate' and 'articulate', for example as described in PCT Application PCT/GB2016/052429 (Published as WO2017/089740). Hence there is provided heat engine or heat pump which comprises a 'roticulating apparatus'.

Roticulation and the roticulating concept hence describe a device in which a single body (e.g. a rotor) rotates whilst simultaneously articulating, describing a 3D spatial movement which can be used to perform volumetric 'work' in conjunction and translation with rotation.

Hence the apparatus offers absolute management and control of multiple volumetric chambers within a single order of mechanical constraints/losses. Given this high ratio of volumetric chambers over mechanical losses the efficiency of the device is of a high order when compared to conventional devices.

Thus this disclosure describes a device capable of both positive displacement and absolute evacuation of its working volumes, such is characteristic of an 'ideal' expander/compressor/pump, offering a high expansion/compression ratio many orders beyond conventional devices.

The apparatus offers the highly desirable characteristic of a single device operable to simultaneously perform the action of expansion of a working fluid as well as compression and/or displacement of the same working fluid.

Thus a heat engine according to the present disclosure may operate with a lower heat differential, utilising lower quality heat than examples of the related art.

Since the first fluid flow section and second fluid flow sections (e.g. the expansion and displacement sections) are linked, a heat pump according to the present disclosure is inherently more efficient than an example of the related art as expansion of the fluid is utilised to drive the displacement/pump/compressing section, thereby requiring less external input from a motor.

Hence apparatus according to the present disclosure may efficiently operate over a wide range of conditions, thereby allowing the device to produce outputs with input conditions which would not provide sufficient energy for examples of the related art to operate.

The provision of the first magnetic guide feature and the second magnetic guide feature, wherein at least one of the first magnetic guide feature and the second magnetic guide feature comprises an electro-magnet, enables the first magnetic guide feature and the second magnetic guide feature to be coupled together. This magnetic coupling enables the rotor to pivot thereby inducing the rotor to pivot about the axle relative to the first piston member. The magnetic coupling reduces friction in the apparatus as the relative position of the rotor and the first piston member can be controlled without the need for a mechanical guide path. The magnetic coupling between the first magnetic guide feature and the second magnetic guide feature may also act to drive the rotation of the shaft about a first rotational axis, thereby removing the requirement for a motor.

BRIEF DESCRIPTION OF THE DRAWINGS

Examples of the present disclosure will now be described with reference to the accompanying drawings, in which.

DETAILED DESCRIPTION

An apparatus and method of operation of the present disclosure is described below.

In particular the present disclosure is concerned with an apparatus comprising a roticulating thermodynamic apparatus configured to be driven by a magnetically coupled track.

That is to say, the apparatus is suitable for use as part of a fluid working apparatus operable as a heat pump and/or a heat engine. Core elements of the apparatus are described as well as non-limiting examples of applications in which the apparatus may be employed.

The term "fluid" is intended to have its normal meaning, for example: a liquid, gas, vapour, or a combination of liquid, gas and/or vapour, or material behaving as a fluid.

Figure 1:
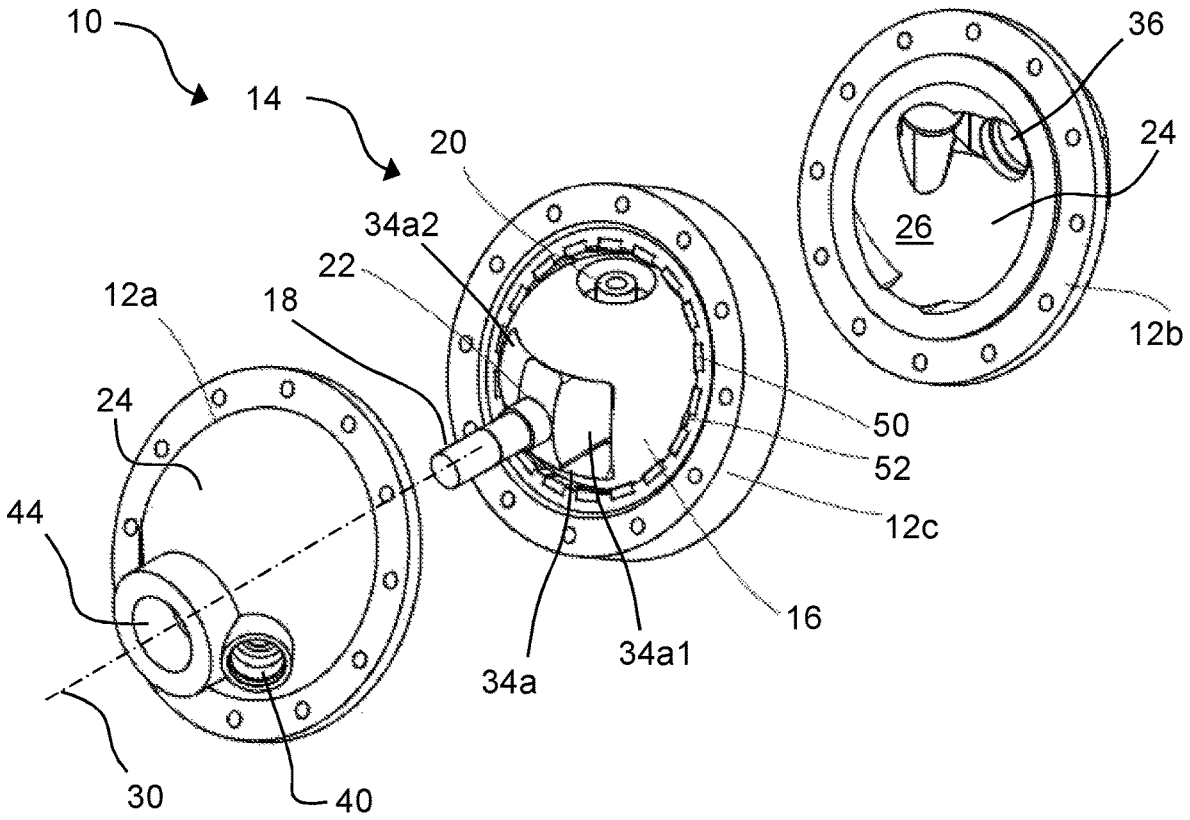
FIG. 1 shows a part exploded view of an example of an apparatus, including a rotor assembly and housing, according to the present disclosure.
Figure 2A:
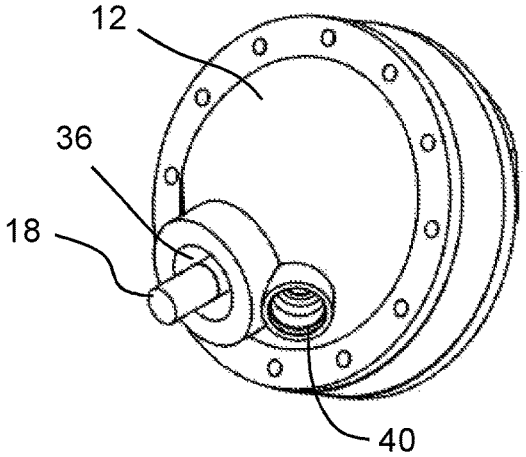
FIG. 2A shows a perspective external view of an apparatus according to the present disclosure.
Figure 2B:
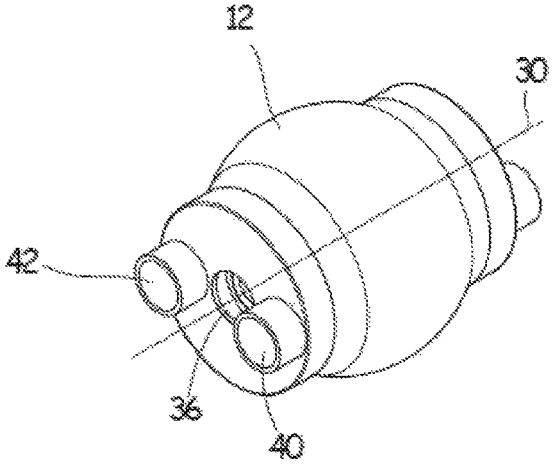
FIG. 2B shows a perspective external view of an apparatus according to the present disclosure with a different housing and porting to that shown in FIGS. 1 and 2A.

FIG. 1 shows a part exploded view of a core 10 part of an apparatus according to the present disclosure. Features of the core 10 are shown in FIGS. 1 to 20, 23, 24 and FIGS. 21, 22 & 25 illustrate how the core 10 is combined with other features in order to produce a roticulating machine operated by a magnetically coupled track. The core comprises a housing 12 and rotor assembly 14. FIG. 2A shows an example of a housing 12 when it is closed around the rotor assembly 14. FIG. 2B shows an alternative example of a housing 12 when it is closed around the rotor assembly 14.

In the example shown in FIG. 1 the housing 12 is divided into three parts 12*a*, 12*b*, 12*c* which close around the rotor assembly 14. In some examples, the housing comprises two parts 12*a*, 12*b* and a spacer ring 12*c*, which separates the two parts 12*a*, 12*b*. In an alternative example the housing may be fabricated from more than three parts, and/or split differently to that shown in FIG. 1. In other examples, the housing 12 may be made from two parts.

The rotor assembly 14 comprises a rotor 16, a shaft 18, an axle 20 and a piston member 22. The housing 12 has a wall 24 which defines a cavity 26, the rotor 16 being rotatable and pivotable within the cavity 26.

The shaft 18 defines, and is rotatable about, a first rotational axis 30. The axle 20 extends around the shaft 18. The axle extends at an angle to the shaft 18. Additionally the axle defines a second rotational axis 32. Put another way, the axle 20 defines the second rotational axis 32, and the shaft 18 extends through the axle 20 at an angle to the axle 20. The piston member 22 is provided on the shaft 18.

In the examples shown the apparatus is provided with two piston members 22, i.e. a first and second piston member 22. The rotor 16 also defines two chambers 34*a,b*, one diametrically opposite the other on either side of the rotor 16. In the example shown in FIG. 1, the first chamber 34*a* comprises two sub-chambers 34*a*1, 34*a*2.

In examples in which the apparatus is part of a fluid compression device, each chamber 34 may be provided as a compression chamber. Likewise, in examples in which the apparatus is a fluid displacement device, each chamber 34 may be provided as a displacement chamber. In examples in which the apparatus is a fluid expansion device, each chamber 34 may be provided as an expansion or metering chamber.

Although the piston member 22 may in fact be one piece that extends all of the way through the rotor assembly 14, this arrangement effectively means each chamber 34 is provided with a piston member 22. That is to say, although the piston member 22 may comprise only one part, it may form two piston members sections 22, one on either side of the rotor assembly 14.

Put another way, a first piston member 22 extends from one side of the axle 20 along the shaft 18 towards one side of the housing 12, and a second piston member 22 extends from the other side of the axle 20 along the shaft 18 towards the other side of the housing 12. The rotor 16 comprises a first chamber 34*a* having a first opening 36 on one side of the rotor assembly 14, and a second chamber 34*b* having a second opening 36 on the other side of the rotor assembly 14. The rotor 16 is carried on the axle 20, the rotor 16 being pivotable relative to the axle 20 about the second rotational axis 32. The piston member 22 extends from the axle 20 across the chambers 34*a,b* towards the openings 36. A small clearance is maintained between the edges of the piston member 22 and the wall of the rotor 16 which defines the chamber 34. The clearance may be small enough to provide a seal between the edges of the piston member 22 and the wall of the rotor 16 which defines the chamber 34. Alternatively, or additionally, sealing members may be provided between the piston members 22 and the wall of the rotor 16 which defines the chamber 34.

The chambers 34 are defined by side walls (i.e. end walls of the chambers 34) which travel to and from the piston members 22, the side walls being joined by boundary walls which travel past the sides of the piston member 22. That is to say, the chambers 34 are defined by side/end walls and boundary walls provided in the rotor 16.

Hence the rotor 16 is rotatable with the shaft 18 around the first rotational axis 30, and pivotable about the axle 20 about the second rotational axis 32. This configuration results in the first piston member 22 being operable to travel (i.e. traverse) from one side of the first chamber 34*a* to an opposing side of the first chamber 34*a* as the rotor 16 rotates about the first rotational axis 30. Put another way, since the rotor 16 is rotatable with the shaft 18 around the first rotational axis 30, and the rotor 16 is pivotable about the axle 20 about the second rotational axis 32, during operation there is a relative pivoting (i.e. rocking) motion between the rotor 16 and the first piston member 22 as the rotor 16 rotates about the first rotational axis 30. That is to say, the apparatus is configured to permit a controlled pivoting motion of the rotor 16 relative to the first piston member 22 as the rotor 16 rotates about the first rotational axis 30.

The configuration also results in the second piston member 22 being operable to travel (i.e. traverse) from one side of the second chamber 34*b* to an opposing side of the second chamber 34*b* as the rotor 16 rotates about the first rotational axis 30. Put another way, since the rotor 16 is rotatable with the shaft 18 around the first rotational axis 30, and the rotor 16 is pivotable about the axle 20 about the second rotational axis 32, during operation there is a relative pivoting (i.e. rocking) motion between the rotor 16 and both piston members 22 as the rotor 16 rotates about the first rotational axis 30. That is to say, the apparatus is configured to permit a controlled pivoting motion of the rotor 16 relative to both piston members 22 as the rotor 16 rotates about the first rotational axis 30.

The relative pivoting motion is induced by a pivot actuator, as described below.

The mounting of the rotor 16 such that it may pivot (i.e. rock) relative to the piston members 22 means that the piston members 22 provide a moveable division between two halves of the or each chambers 34*a,b* to form sub-chambers 34*a*1, 34*a*2, 34*b*1, 34*b*2 within the chambers 34*a*,34*b*. In operation the volume of each sub chamber 34*a*1, 34*a*2, 34*b*1 and 34*b*2 varies depending on the relative orientation of the rotor 16 and piston members 22.

When the housing 12 is closed about the rotor assembly 14, the rotor 16 is disposed relative to the housing wall 24 such that a small clearance is maintained between the chamber opening 34 over the majority of the wall 24. The clearance may be small enough to provide a seal between the rotor 16 and the housing wall 24.

Alternatively or additionally, sealing members may be provided in the clearance between the housing wall 24 and rotor 16.

Ports are provided for the communication of fluid to and from the chambers 34*a,b*. For each chamber 34, the housing 12 may comprise an inlet port 40 for delivering fluid into the chamber 34, and an exhaust/outlet port 42 for expelling fluid from the chamber 34. The ports 40, 42 extend through the housing and open onto the wall 24 of the housing 12.

The inlet and outlet/exhaust ports 40, 42 are shown in different orientations in FIG. 1 and FIG. 2B. In FIG. 1 the flow direction defined by each port is at an angle to the first rotational axis 30. In FIG. 2B the flow direction defined by each port is parallel to the first rotational axis 30. The ports 40, 42 may have the same flow areas. In other examples the ports 40, 42 may have different flow areas.

Also provided is a bearing arrangement 44 for supporting the ends of the shaft 18. This may be of any conventional kind suitable for the application.

The ports 40, 42 may be sized and positioned on the housing 12 such that, in operation, when respective chamber openings 36 move past the ports 40, 42, in a first relative position the openings 36 are aligned with the ports 40, 42 such that the chamber openings are fully open, in a second relative position the openings 36 are out of alignment such that the openings 36 are fully closed by the wall 24 of the housing 12, and in an intermediate relative position, the openings 36 are partly aligned with the ports 40, 42 such that the openings 36 are partly restricted by the wall of the housing 24.

Alternatively, the ports 40,42 may be sized and positioned on the housing 12 such that, in operation, in a first range (or set) of relative positions of the ports 40,42 and the respective rotor openings 36, the ports 40,42 and rotor openings 36 are out of alignment such that the openings 36 are fully closed by the wall 24 of the housing 12 to prevent fluid flow between the sub-chambers 34*a*1, 34*a*2 and their respective port(s) 40,42, and to prevent fluid flow between the sub-chambers 34*b*1, 34*b*2 and their respective port(s) 40,42. In a second range (or set) of relative positions of the ports 40,42 and the respective rotor chamber openings 36, the openings 36 are at least partly aligned with the ports 40,42 such that the openings 36 are at least partly open to allow fluid to flow between the sub chambers of chamber(s) 34*a*,*b* and their respective port(s) 40,42. Hence the sub-chambers are operable to increase in volume at least when in fluid communication with an inlet port (to allow for fluid flow into the sub-chamber), and the sub-chambers are operable to decrease in volume at least when in fluid communication with an outlet port (to allow for fluid flow out of the sub-chamber).

The placement and sizing of the ports may vary according to the application (i.e. whether used as part of a fluid pump apparatus, fluid displacement apparatus, fluid expansion apparatus) to facilitate best possible operational efficiency. The port locations herein described and shown in the figures is merely indicative of the principle of media (e.g. fluid) entry and exit.

In some examples of the apparatus of the present disclosure (not shown) the inlet ports and outlet ports may be provided with mechanical or electro-mechanical valves operable to control the flow of fluid/media through the ports 40,42.

Figure 3A:
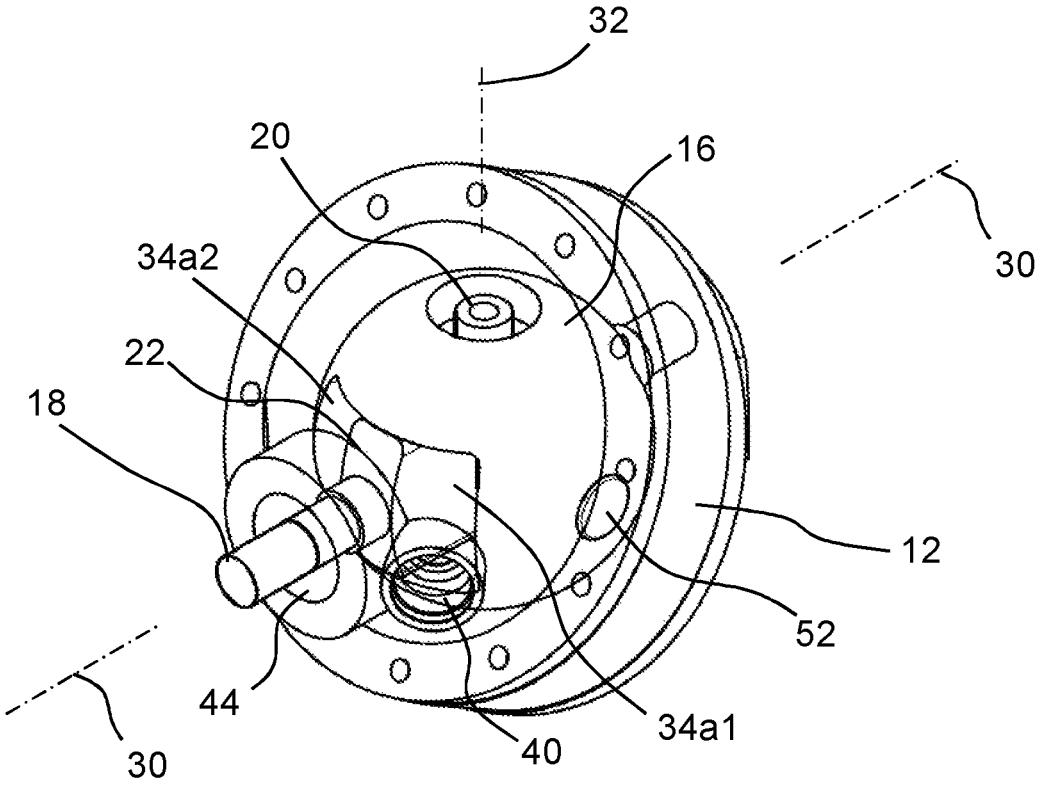
FIG. 3A shows a perspective semi "transparent" assembled view of the apparatus of FIGS. 1 and 2A.

FIG. 3A shows a perspective semi "transparent" assembled view of the apparatus of FIGS. 1 and 2A. For clarity, the second guide feature 50 is not shown in FIG. 3A.

Figure 3B:
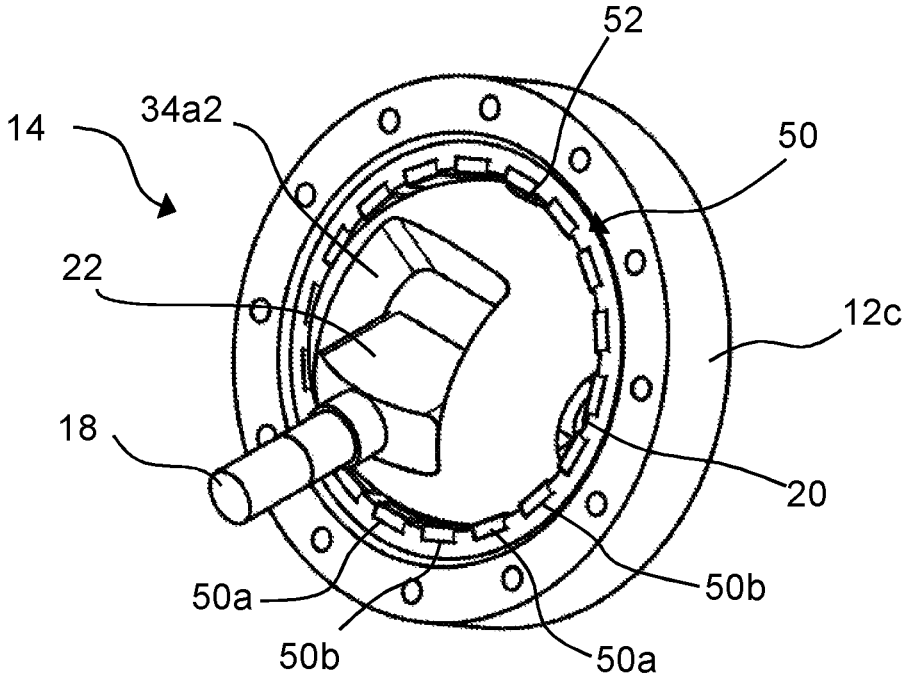
FIG. 3B shows the rotor assembly of FIG. 1 in more detail with parts of the housing removed.

The apparatus may comprise a pivot actuator. A non-limiting example of the pivot actuator is illustrated in FIG. 3B, which corresponds to that shown in FIGS. 1, 2.

The pivot actuator comprises an magnetically coupled arrangement configured to control the pivoting motion of the rotor. That is to say the pivot actuator may comprise a first magnetic guide feature 52 provided on the rotor 16, and a second magnetic guide feature 50 provided on the housing 12. The first magnetic guide feature 52 is operable to co-operate with the second magnetic guide feature 50 to pivot the rotor about the axle. At least one of the first guide feature 52 and second guide feature 50 comprises an electro-magnet operable to magnetically couple to the other of the first guide feature 52 and second guide feature 50. In some examples, the magnetic coupling between the first magnetic guide feature 52 and the second magnetic guide feature 50 may also act to drive the rotation of the shaft 18 about a first rotational axis 30 such that a separate motor is not required.

In whatever form provided, the pivot actuator is operable (i.e. configured) to pivot the rotor 16 about the axle 20. That is to say, the apparatus may further comprise a pivot actuator operable (i.e. configured) to pivot the rotor 16 about the second rotational axis 32 defined by the axle 20. The pivot actuator may be configured to pivot the rotor 16 by any angle appropriate for the required performance of the apparatus. For example the pivot actuator may be operable to pivot the rotor 16 through an angle of substantially about 60 degrees. The use of the magnetic coupling enables the rotor 16 to pivot through an angle of between 0 and 90 degrees.

The pivot actuator may comprise, as shown in the examples, a first magnetic guide feature 52 on the rotor 16, and may have a second magnetic guide feature 50 on the housing 12. Hence the pivot actuator may be provided as a magnetic link between the rotor 16 and housing 12 configured to induce a controlled relative pivoting motion of the rotor 16 relative to the piston member 22 as the rotor 16 rotates about the first rotational axis 30. That is to say, it is the relative movement of the rotor 16 under the magnetic influence of the pivot actuator induces the pivoting motion of the rotor 16. In some examples, the magnetic coupling between the first magnetic guide feature 52 and the second magnetic guide feature 50 may also act to drive the rotation of the shaft 18 about a first rotational axis 30 such that a separate motor is not required.

The first magnetic guide feature 52 may be complementary in shape to the second guide feature 50. In some examples, there may be a small clearance provided between the first magnetic guide feature 52 and the second guide feature 50. One of the first or second magnetic guide features 50, 52 define a path which the other of the first or second magnetic guide members features is magnetically constrained to follow as the rotor rotates about the first rotational axis 30. The path has a route configured to induce the rotor 16 to pivot about the axle 20 and axis 32. This route also acts to set the mechanical advantage between the rotation and pivoting of the rotor 16.

Figure 4:
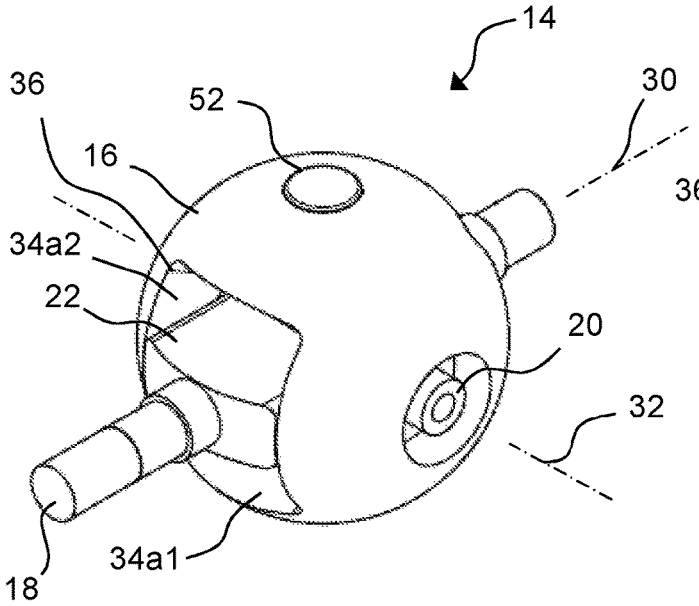
FIG. 4 shows the rotor assembly of FIG. 1 in more detail.
Figure 6:
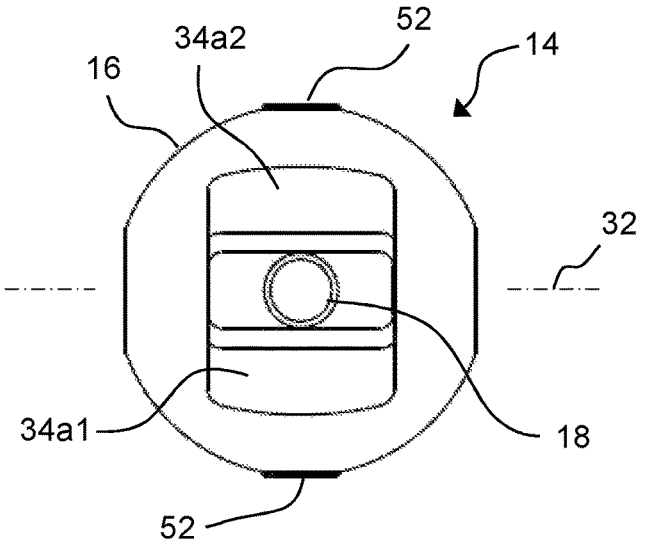
FIG. 6 shows an end on view of the rotor assembly of FIG. 4.
Figure 7:
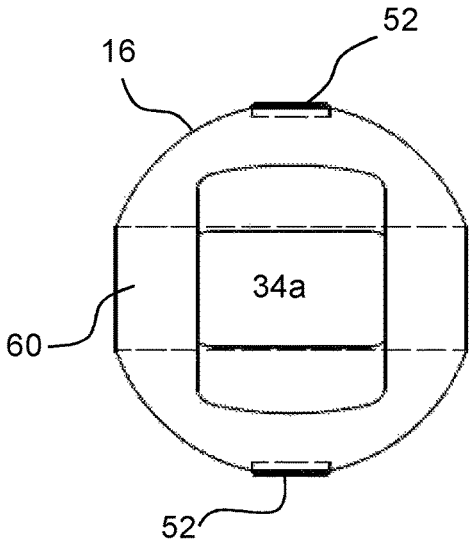
FIG. 7 shows an end on view of the rotor of FIG. 5, with the addition of magnets located on the rotor.

As shown in the example of FIG. 1, and more clearly in FIG. 3B, a first magnetic guide feature 52, in the form of a magnet 52, for example an electro-magnet, is provided on the rotor 16. Whilst the first magnetic guide feature 52 shown in FIGS. 3A and 4 is shown as comprising one magnet, in some examples, the first magnetic guide features comprises two magnets 52 as shown in FIG. 6. In some examples, two magnets may be diametrically opposed on the rotor 16. In other examples, the first magnetic guide feature 52 comprises a plurality of magnets arranged on the rotor 16. In some examples, the plurality of magnets may be arranged in a circular fashion on the outside of the rotor 16.

FIG. 3B shows an example of part of the housing 12*c*, the second magnetic guide feature 50 and the rotor assembly arranged within or on the housing 12. In the example of FIG. 3B, some parts of the housing 12 have been removed for clarity. In some examples, the second magnetic guide feature 50 is coupled with the spacer ring 12*c* and in other examples, the second magnetic guide feature 50 is integral with the spacer ring 12*c* and/or housing 12.

In this example, the second magnetic guide feature 50 includes a plurality of magnets, for example, electro-magnets. The second magnetic guide feature 50 may be in the form of a circular or cylindrical arrangement around the outside of the rotor 16. In some examples, the plurality of electro-magnets of the second magnetic guide feature 50 are substantially located on a plane. The second magnetic guide feature 50 may be considered to be an induction loop. In one example, the second magnetic guide feature 50 comprises a plurality of alternately charged electromagnets, which may be magnetically coupled with the first magnetic guide feature 52. The electromagnets of the second magnetic guide feature 50 may comprise a plurality of coils supplied with current by a controller.

In one example, a first set of electromagnets 50*a* of the second magnetic guide feature 50 have a positive polarity facing the rotor 16 whist a second set of electromagnets 50*b* of the second magnetic guide feature 50, arranged alternately with the first set, may have a negative polarity facing the rotor 16. In other words, in this example, the second magnetic guide feature 50 includes a positively polarised electromagnet 50*a* followed by a negatively polarised electromagnet 50*b* facing the rotor 16, followed by a positively polarised electromagnet 50*a*, and so on. The alternately polarised electromagnets 50*a*, 50*b* may be in the form of a stator coils.

In use, electric power may be provided to the electromagnets 50*a*, 50*b* of the second magnetic guide feature 50, which causes an electric current to flow through the electromagnets 50*a*, 50*b*, which in turn causes each of the electromagnets to develop a magnetic field. In this example, the first magnetic guide feature 52 will be magnetically coupled to the second magnetic guide feature 50. As adjacent electromagnets of the second magnetic guide feature 50 have opposing magnetic polarities, in use, a first magnetic guide feature 52 in the form of a magnet on the rotor will be simultaneously attracted to one electro-magnet and repelled by a second, adjacent electro-magnet. The attraction and repulsion will induce a combined force on the first magnetic guide feature 52, for example a magnet, on the rotor 16, which causes the rotor 16 to pivot relative to the piston member 22. In some examples, the magnetic coupling between the first magnetic guide feature 52 and the second magnetic guide feature 50 may also act to drive the rotation of the shaft 18 about a first rotational axis 30 such that a separate motor is not required.

For example, the first magnetic guide feature 52 may comprise a magnet on the rotor 16 with its positive polarity side facing the second magnetic guide feature 50. The magnet may be arranged in between a first electro-magnet 50*a* and a second electro-magnet 50*b* of the second magnetic guide feature 50. The second magnetic guide feature 50 may also includes a third electro-magnet 50*a* with a matching polarity to the first electro-magnet, on the opposite side of the second electro-magnet to the first electro-magnet.

In this example, the first electromagnet 50*a* of the second magnetic guide feature 50 has a negative polarity facing the magnet of the first magnetic guide feature 52, whereas the second electromagnet 50*b* of the second magnetic guide feature 50 has a positive polarity facing the magnet of the first magnetic guide feature 52 such that the first electromagnet 50*a* will attract the magnet of the first magnetic guide feature 52, whereas the second electromagnet 50*b* will repel the magnet of the first magnetic guide feature 52, thereby causing the rotor 16 to pivot. In this example, as the magnet of the first magnetic guide feature 52 substantially aligns with or passes the first electromagnet 50*a* of the second magnetic guide feature 50, then the polarity of the electromagnets 50*a* and 50*b* is switched or reversed, i.e. the first electromagnet 50*a* of the second magnetic guide feature 50 now has a positive polarity facing the magnet of the first magnetic guide feature 52, whereas the second electromagnet 50*b* of the second magnetic guide feature 50 now has a negative polarity facing the magnet of the first magnetic guide feature 52. As such, the first electromagnet 50*a* of the second magnetic guide feature 50 will now repel the first magnetic guide feature 52. The third electromagnet 50*a* has a polarity matching the first electromagnet and so acts to attract the magnet of the first magnetic guide feature 52, thereby continuing the rotation of the rotor 16. In this example, the magnetic coupling of the first magnetic guide feature 52 and the second magnetic guide feature 50 causes the rotor 16 to pivot relative to the piston member 22. In some examples, the magnetic coupling between the first magnetic guide feature 52 and the second magnetic guide feature 50 may also act to drive the rotation of the shaft 18 about a first rotational axis 30 such that a separate motor is not required.

A rotor assembly 14 akin to the example shown in FIGS. 1, 3A, 3B is shown in FIGS. 4 to 7. As can be seen there is provided a magnet 52 on the rotor 16 operable to be magnetically coupled with the second magnetic guide feature 50.

Figure 5:
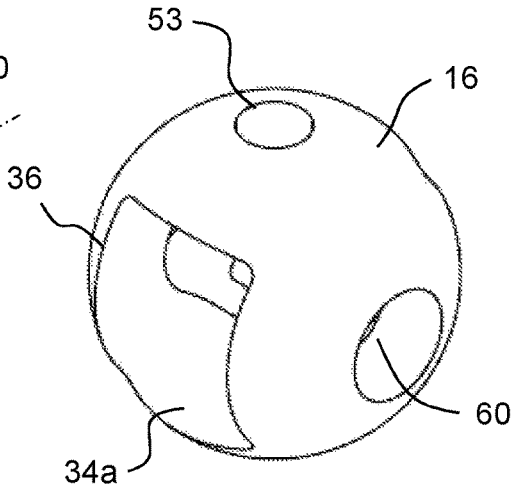
FIG. 5 shows the rotor of the rotor assembly of FIG. 4.

The rotor 16 may be substantially spherical. As shown, the rotor 16 may be, at least in part, substantially spherical. For convenience FIG. 4 shows the entire rotor assembly 14 with shaft 18, axle 20 and piston member 22 fitted. By contrast, FIG. 5 shows the rotor 16 by itself, and a cavity 60 which extends through the rotor 14 and is configured to receive the axle 20. FIG. 5 shows the recess or opening 53 configured to receive and hold the first magnetic guide feature 52. For clarity, the first magnetic guide feature 52 has been removed from the rotor assembly 14. FIG. 6 shows a view looking along the first rotational axis 30 on FIG. 6, and FIG. 7 the same view as shown in FIG. 6 looking down the opening 36 which defines the chamber 34 of the rotor 14, but with the magnets inserted into the recesses 53.

Figure 8:
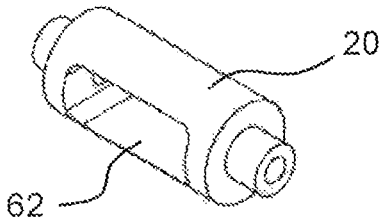
FIG. 8 shows a perspective view of an axle of the rotor assembly.
Figure 9:
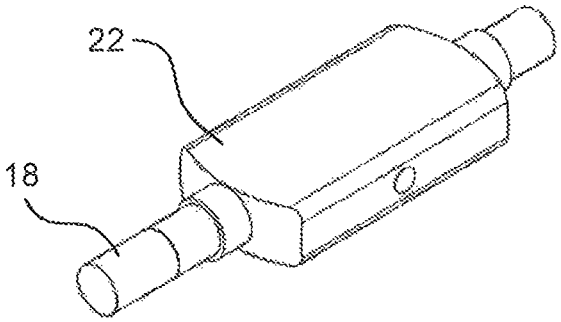
FIG. 9 shows an perspective view of a shaft of the rotor assembly.
Figure 10:
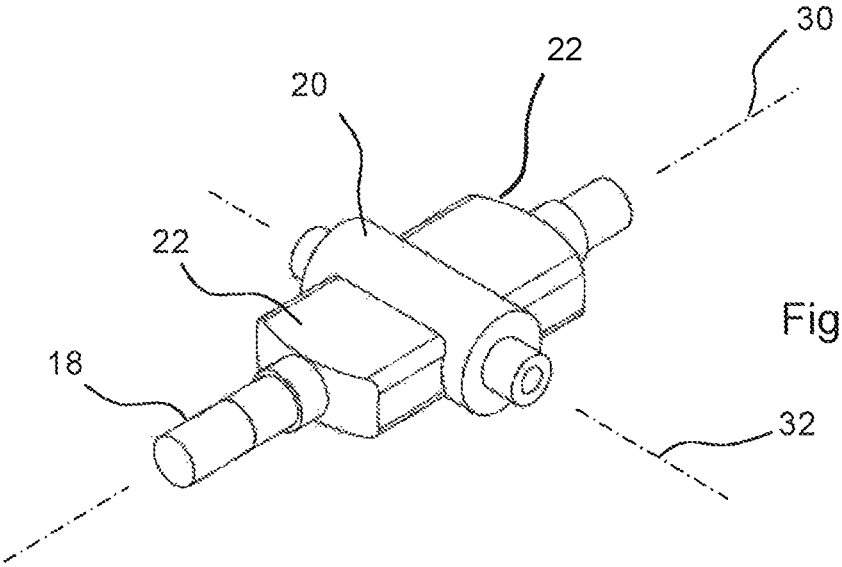
FIG. 10 shows an assembly of the axle of FIG. 8 and the shaft of FIG. 9.

FIG. 8 shows a perspective view of the axle 20 having the passage 62 for receiving the axle 18 and piston member 22. The axle 20 is substantially cylindrical. FIG. 9 shows an example configuration of the shaft 18 and piston member 22. The shaft 18 and piston member 22 may be integrally formed, as shown in FIG. 10, or may be fabricated from a number of parts. The piston member 22 is substantially square or rectangular in cross section. As shown in the figures, the shaft 18 may comprise cylindrical bearing regions which extend from the piston member 22 in order to seat on the bearing arrangement 44 of the housing 12, and hence permit rotation of the shaft 18 around the first rotational axis 30.

FIG. 10 shows the shaft 18 and piston member 22 assembled with the axle 20. They may be formed as an assembly, as described above, or they may be integrally formed as one, perhaps by casting or forging.

The axle 20 may be provided substantially at the centre of the shaft 18 and piston member 22. That is to say, the axle 20 may be provided substantially halfway between the two ends of the shaft 18. When assembled, the shaft 18, axle 20 and piston member 22 may be fixed relative to one another. The axle 20 may be substantially perpendicular to the shaft and piston member 22, and hence the second rotational axis 32 may be substantially perpendicular to the first rotational axis 30.

The piston members 22 are sized to terminate proximate to the wall 24 of the housing 12, a small clearance being maintained between the end of the piston members 22 and the housing wall 24. The clearance may be small enough to provide a seal between the piston members 22 and the housing wall 24. Alternatively or additionally, sealing members may be provided in the clearance between the housing wall 24 the piston members 22.

Figure 11:
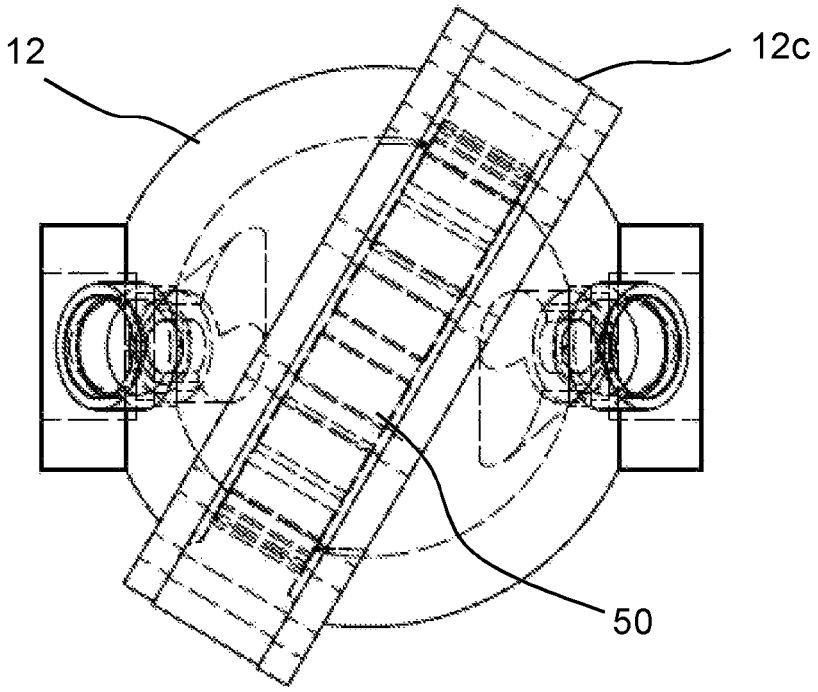
FIG. 11 shows a plan view of the housing shown in FIG. 1, with hidden detail shown in dotted lines.
Figure 12:
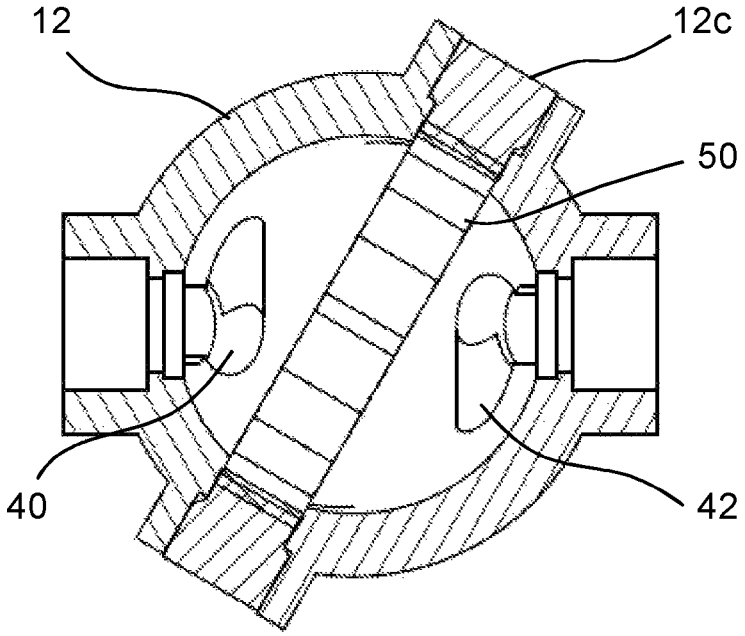
FIG. 12 shows an internal view of the housing shown in FIG. 11.

Further examples of a second magnetic guide feature 50 are shown in cross section in FIGS. 11, 12 which correspond to the example of FIG. 1. In this example the second magnetic guide feature 50 is substantially circular (i.e. with no inflexions).

The rotor 14 may be provided in one or more parts which are assembled together around the shaft 18 and axle 20 assembly. Alternatively the rotor 16 may be provided as one piece, whether integrally formed as one piece or fabricated from several parts to form one element, in which case the axle 20 may be slid into the cavity 60, and then the shaft 18 and piston member 22 slid into a passage 62 formed in the axle 20, and then fixed together. A small clearance may be maintained between the axle 20 and bore of the cavity 60 of rotor 16. The clearance may be small enough to provide a seal between the axle 20 and the rotor 16 bore of the cavity 60. Alternatively or additionally, sealing members may be provided in the clearance between the axle 20 and rotor 16 bore of the cavity 60.

As shown in FIGS. 11 and 12, in an example where the guide feature is provided as a path on the housing 12, the guide path defined by the second magnetic guide feature 50 describes a path around (i.e. on, close to, and/or to either side of) a first circumference of the housing. In this example the plane of the first circumference overlays, or is aligned with, the plane described by the second rotational axis 32 as it rotates about the first rotational axis 30.

Figure 13:
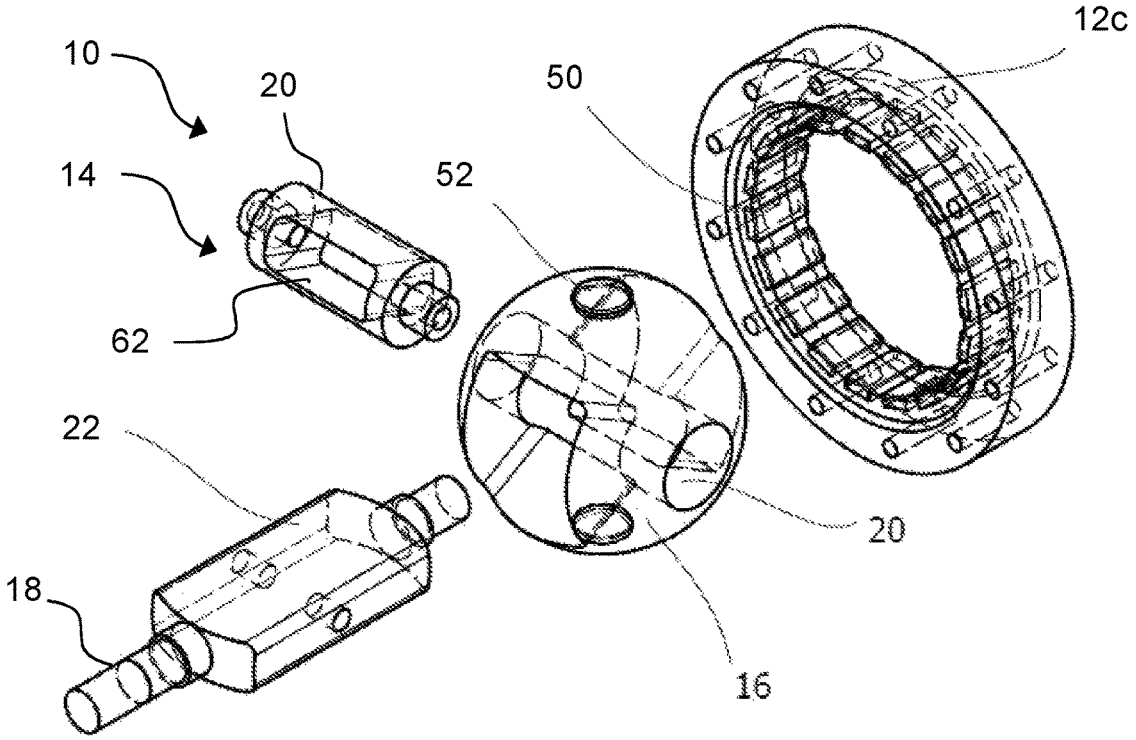
FIG. 13 shows an exploded view of the components of the rotor assembly 14 and second guide feature 50.

FIG. 13 shows an exploded view of a core 10 part of an apparatus according to the present disclosure. The second magnetic guide feature 50 is the same as shown in FIGS. 3B, 11 and 12. In this example, the second magnetic guide feature 50 comprises a plurality of magnets, for example electro-magnets, arranged in the inner face of a spacer ring 12*c*. The electromagnets are arranged such that the polarity of the inner face of adjacent electromagnets are oppositely polarised. For example, a first set of electromagnets and a second set of electromagnets are alternately arranged around the inner face of the spacer ring 12*c*. The polarity of the first set of electromagnets and the second set of electromagnets may switch during operation, but the first set of electromagnets will always have the same polarity as each other and the second set of electromagnets will always have the same polarity as each other. In this example, the magnetic coupling between the first magnetic guide feature 52 and the second magnetic guide feature 50 causes the rotor 16 to pivot relative to the piston member 22. In some examples, the magnetic coupling between the first magnetic guide feature 52 and the second magnetic guide feature 50 may also act to drive the rotation of the shaft 18 about a first rotational axis 30 such that a separate motor is not required.

Figure 14A:
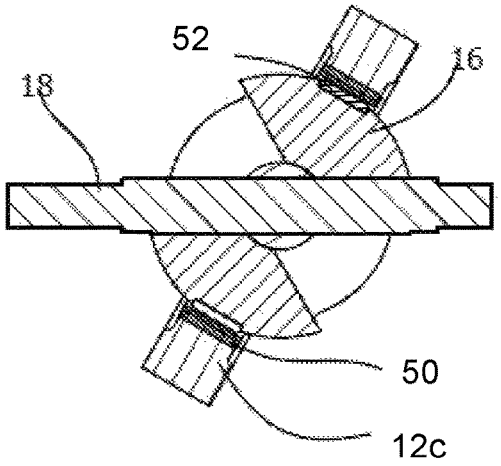
FIG. 14A shows a cross section an assembled example of a rotor showing relative positioning of the parts shown in FIG. 13.
Figure 14B:
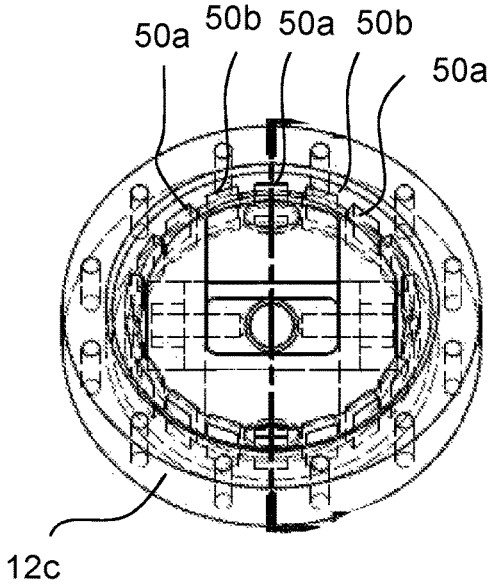
FIG. 14B shows an end elevation of the rotor shown in FIG. 14A.

FIG. 14A shows a cross-section through the core 10 and rotor assembly 14. As shown in FIG. 14A, the first magnetic guide feature 52 and the second magnetic guide feature 50 may have a very small clearance between them. The small clearance increases the magnetic force developed, whilst ensuring that there is no friction between the first magnetic guide feature 52 and the second magnetic guide feature 50. The alternating arrangement of the first set of electromagnets 50*a* and the second set of electromagnets 50*b* is shown in more detail in FIG. 14B.

Figure 15:
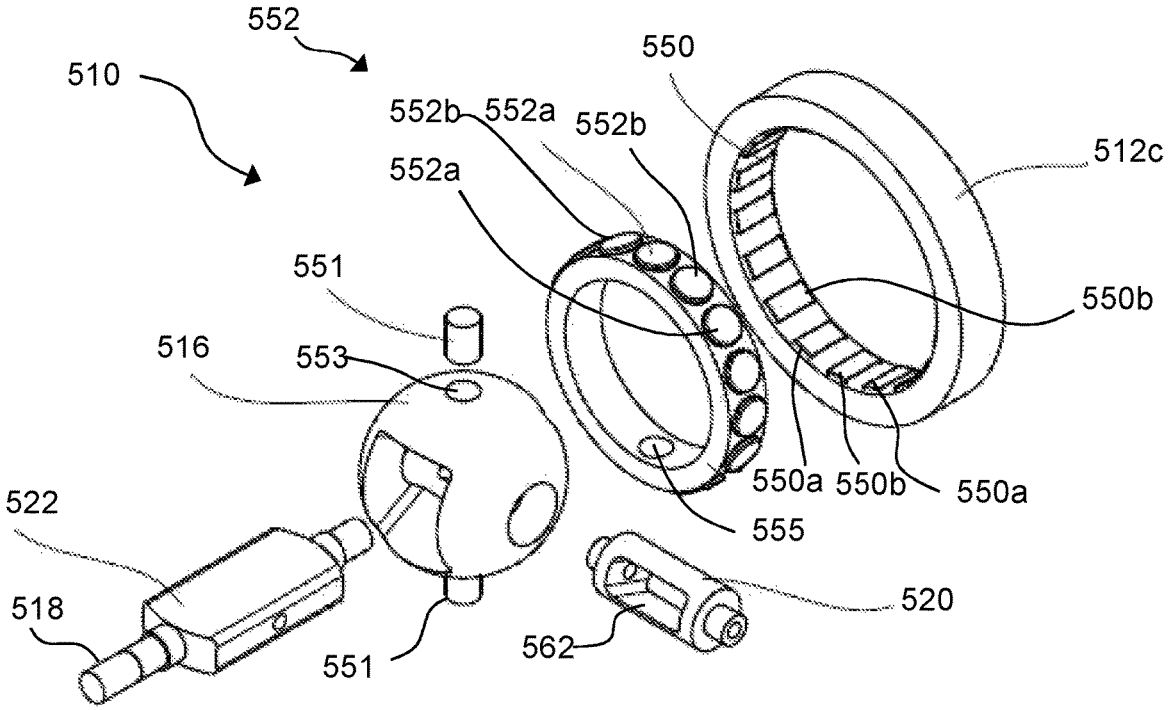
FIG. 15 shows an exploded view of the components of a rotor assembly according to an alternative example.
Figure 16A:
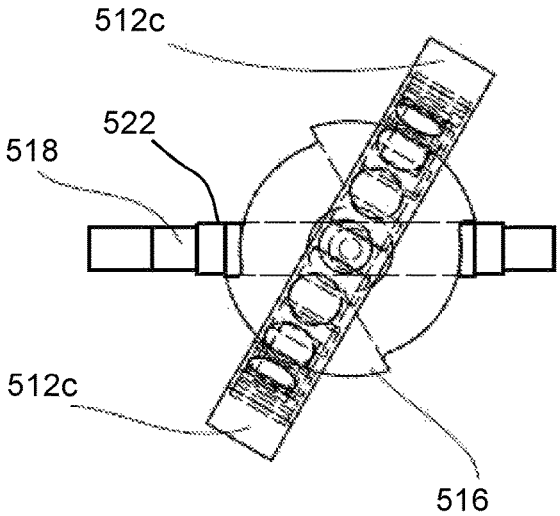
FIGS. 16A and 16B shows a side view and perspective view respectively of the rotor assembly of FIG. 15.
Figure 16B:
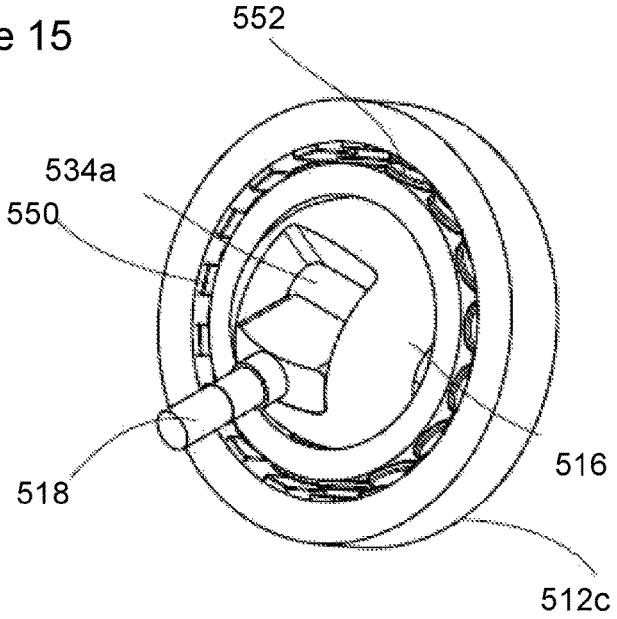
Figure 17A:
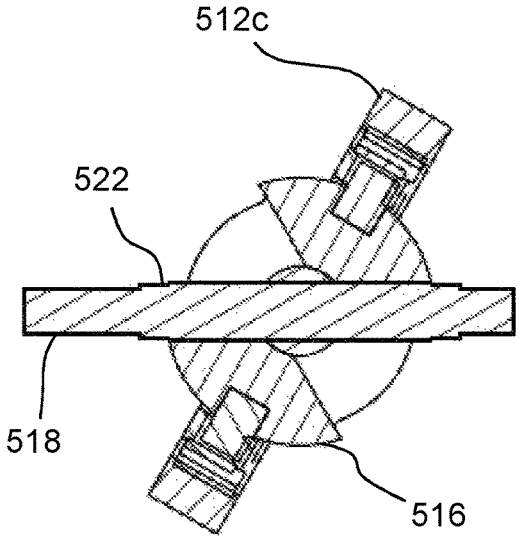
FIGS. 17A and 17B shows a cross section and an end elevation view respectively of the rotor assembly of FIG. 15.
Figure 17B:
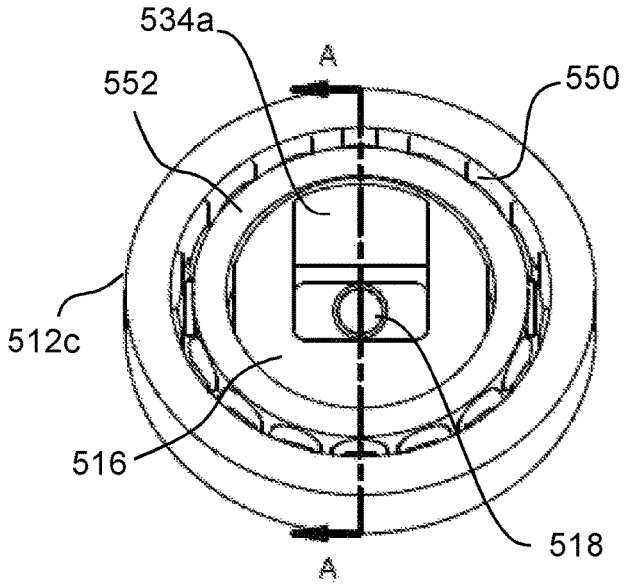

FIGS. 15 to 17 show an alternative example of the core 510. In this example, the piston 522, shaft 518 and axle 520 are substantially identical to the piston 22, shaft 18 and axle 20 shown in FIGS. 8 to 10. Further, the rotor 516 is substantially similar to the rotor 16 shown in FIGS. 1 to 7, except that the rotor 516 includes a recess or opening 553 for receiving an engagement fixture 551, such as a pivot pin. In some examples, the rotor 516 includes two recesses or openings 553 formed on the rotor for receiving engagement fixtures 551 in the form of pivot pins. The recesses or openings 553 may be diametrically opposed on the rotor 516.

In this example, the first guide feature 552 is in the form of a ring comprising a plurality of magnets arranged on the outside diameter of the ring. In some examples, the plurality of magnets of the first guide feature 552 are a plurality of electro-magnets. The ring may be considered to be an orbital slewing ring. The first guide features 552 also includes a recess or opening 555 configured to receive the engagement fixtures 551 to couple the first guide feature 552 to the rotor 516. In some examples, the first guide feature 552 may pivot about the engagement fixture 551 relative to the rotor 516.

In some examples, the first engagement feature comprises at least 10 magnets arranged on the outside of the ring, more preferably at least 15 magnets arranged on the outside of the ring and even more preferably at least 19 magnets arranged on the outside of the ring. In this example, adjacent magnets arranged on the outside of the ring have opposite polarities facing outwards (i.e. towards the second magnetic engagement feature 552). For example, there is a first set of magnets with a positive polarity facing outwards arranged alternately with second set of magnets with a negative polarity facing outwards.

In this example, the second magnetic engagement feature 550 is substantially identical to the second magnetic engagement feature 50 shown in FIGS. 1 to 2 and 11 to 12.

The spacing of the magnets of the first engagement feature 552 substantially matches the spacing of the electromagnets of the second engagement feature 550. Therefore, in use, the magnets of the first engagement feature 552 may be substantially aligned with the electro-magnets of the second magnetic engagement feature 550. As disclosed in relation to the example in FIG. 3B, the electro-magnets 550*a*, 550*b* of the second magnetic engagement feature 550 also have alternate polarities such that adjacent electromagnets 550*a*, 550*b* have opposite polarities. The operation of the first magnetic guide feature 552 and the second magnetic guide feature 550 is substantially identical to the operation described above in relation to FIG. 3B, except that in this case, each pair of adjacent electro-magnets of the second guide feature 550 has a magnet from the first magnetic guide feature 552 between them. As such, more force will be developed to rotate and/or pivot the rotor 516 compared with the example of the core 10 in FIG. 3B. In use, the first engagement feature 552 will be driven around a plane defined by the second magnetic guide feature 550.

Figure 18:
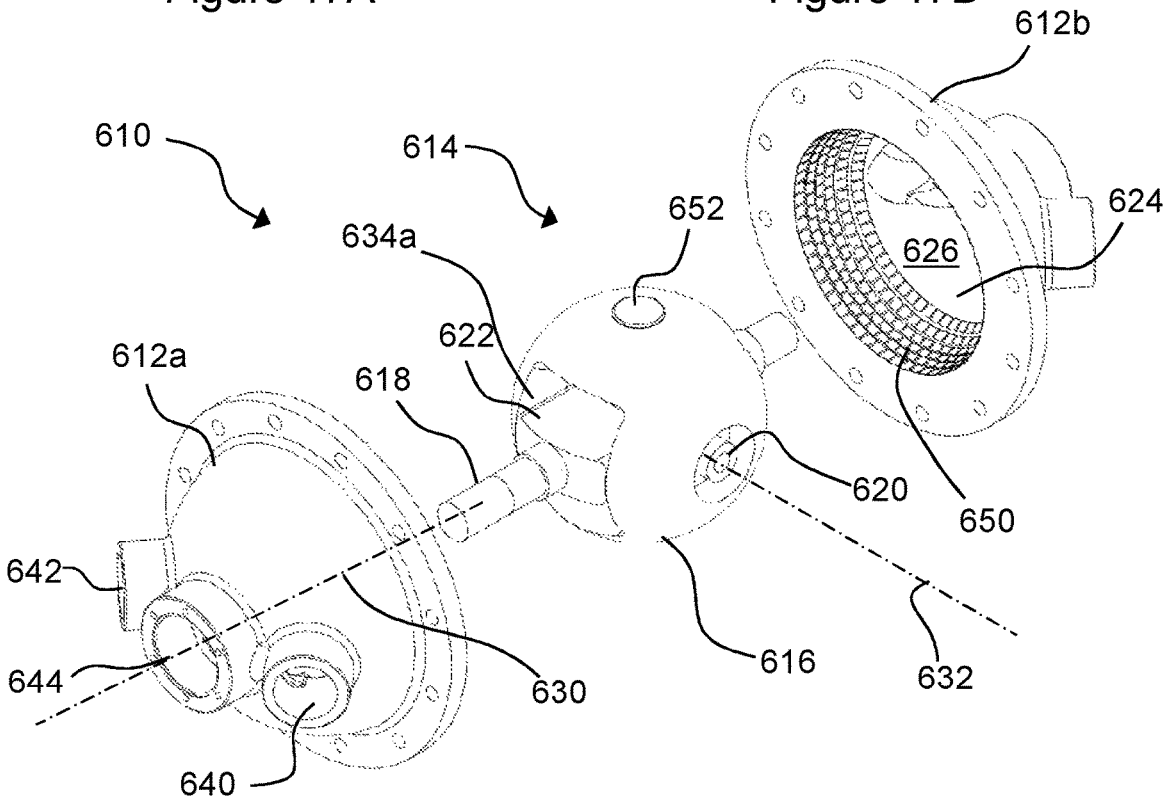
FIG. 18 shows an exploded view of the components of a rotor assembly according to an alternative example.
Figure 19A:
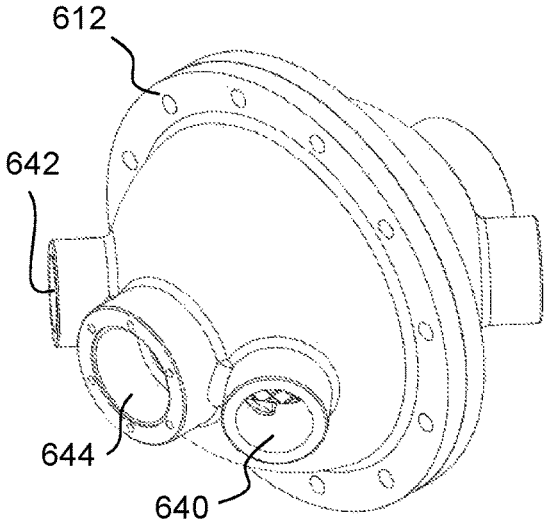
FIGS. 19A and 19B shows a perspective view and side view of the assembled housing of the example shown in FIG. 18.
Figure 19B:
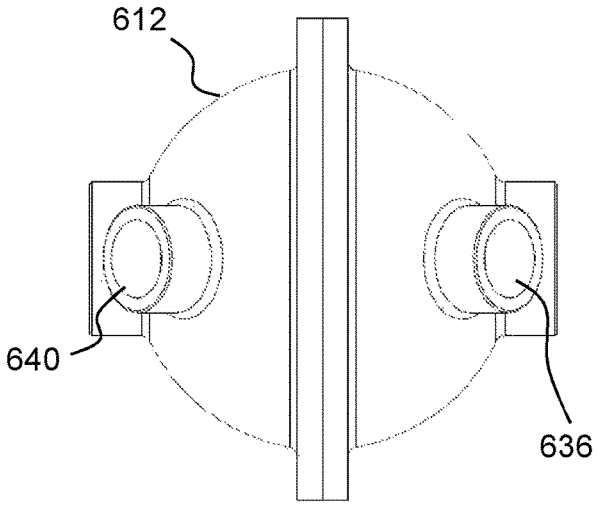

FIGS. 18 and 19 show an alternative example of the core 610. FIG. 18 shows the housing comprised of two parts 612*a*, 612*b*, but in practise, the housing 612 may comprise more than two parts.

In this example, the rotor assembly 614 is substantially identical to the rotor assembly 14 shown in FIGS. 1 to 7 and 13 to 14. A first magnetic guide feature 52 is provided on the rotor 616. As with the example shown in FIG. 4, the first magnetic guide feature 52 may comprise one or two magnets or magnet clusters arranged on the outer surface of the rotor 616. In one example, the first magnetic guide feature 52 comprises two diametrically opposed magnets on the outside of the rotor 616. The two diametrically opposed magnets may have opposing polarities facing outwards. In one example, the two magnets of the first magnetic guide 52 may have opposite polarities facing outwards.

In the examples shown in FIGS. 18 and 19, the second magnetic guide feature 650 comprises and array of electro-magnets arranged on the inner surface of the housing 612. A controller (not shown) may be used to control the polarity of each of the electro-magnets of the second magnetic guide feature 650. In this example, the magnets of the first magnetic guide feature 650 will be magnetically coupled to the electro-magnets of the second magnetic guide feature 650 to cause the rotor 16 to pivot relative to the piston member 22. In some examples, the magnetic coupling between the first magnetic guide feature 652 and the second magnetic guide feature 650 may also act to drive the rotation of the shaft 18 about a first rotational axis 30 such that a separate motor is not required. In use, the guide path of the rotor 614 as it spins may be non-linear and may comprise at least a first inflexion point to direct the path away from a first side of the plane of the second rotational axis 632, then toward a second side of the plane of the second rotational axis 632, and a second inflexion point (on the opposite side of the housing) to direct the guide path away from the second side of the plane of the second rotational axis 632 and then back toward the first side of the plane of the second rotational axis 632. Hence the guide path is not aligned with the plane of the second rotational axis 632, but rather oscillates from side to side of the plane of the second rotational axis 632. That is to say, the guide path does not sit on the plane of the second rotational axis 632, but defines a sinusoidal route between either side of the plane of the second rotational axis 632. The path may be offset from the second rotational axis 632. Hence as the rotor 616 is turned about the first rotational axis 630, the interaction of the first magnetic guide feature 652 and the second magnetic guide feature 650 tilts (i.e. rocks or pivots) the rotor 616 backwards and forwards around the axle 620 and hence the second rotational axis 632. Further, the magnetic coupling between the first magnetic guide feature 652 and the second magnetic guide feature 650 may also act to drive the rotation of the shaft 618 about a first rotational axis 630 such that a separate motor is not required.

In such an example, the distance which the guide path extends from an inflexion on one side of the plane of the second rotational axis 632 to an inflexion on the other side of the plane of the second rotational axis 632 defines the relationship between the pivot angle of the rotor 616 about the second rotational axis 632 and the angular rotation of the shaft 618 about the first rotational axis 630. The number of inflexions defines a ratio of number of pivots (e.g. compression, expansion, displacement cycles etc) of the rotor 616 about the second rotational axis 632 per revolution of the rotor 616 about the first rotational axis 630.

That is to say, the trend of the guide path defines a ramp, amplitude and frequency of the rotor 616 about the second rotational axis 632 in relation to the rotation of the first rotational axis 630, thereby defining a ratio of angular displacement of the chambers 634 in relation to the radial reward from the shaft (or vice versa) at any point.

Put another way the attitude of the guide path, defined by the interaction between the first magnetic guide feature 652 and the second magnetic guide feature 650 directly describes the mechanical ratio/relationship between the rotational velocity of the rotor and the rate of change of volume of the rotor chambers 634*a*, 634*b*. That is to say, the trajectory of the guide path directly describes the mechanical ratio/relationship between the rotational velocity of the rotor 616 and the rate of pivot of the rotor 616. Hence the rate of change and extent of displacement in chamber volume in relation to the rotational velocity of the rotor assembly 614 is set by the severity of the trajectory change (i.e. the inflexion) of the guide path.

The profile of the guide path, defined by the magnetic interaction between the first magnetic guide feature 652 and the second magnetic guide feature 650 can be tuned to produce a variety of displacement versus compression characteristics, as combustion engines for petrol, diesel (and other fuels), pump and expansion may require different characteristics and/or tuning during the operational life of the rotor assembly. Put another way, the trajectory of the guide path can be varied.

Thus the guide path may provide a "programmable guide path" which may be pre-set for any given application of the apparatus. That is to say, the route may be optimised to meet the needs of the application. Put another way, the guide path may be programmed to suit differing applications.

In some examples, a controller (not shown) may be used to control the polarity of each of the electro-magnets of the first magnetic guide feature and/or the second magnetic guide feature 650. As such, the guide path may be moveable to allow adjustment of the guide path, which may provide dynamic adjustment of the guide path while the apparatus is in operation. This may allow for tuning of rate and extent of the pivoting action of the rotor about the second rotational axis to assist with controlling performance and/or efficiency of the apparatus. That is to say, an adjustable guide path would enable variation of the mechanical ratio/relationship between the rotational velocity of the rotor and the rate of change or extent of displacement of the volume of the rotor chambers 634*a*, 634*b*. Hence the guide path results from the magnetic coupling of the first magnetic guide feature 652 and the second magnetic guide feature 650.

This example provides a variable speed, variable volume and variable acceleration/deceleration of the opening and closing of the compression chambers 634*a*, 634*b*. In this example, the rotor assembly 614 may enact a straight line reward (or any other) rather than a sinusoidal opening and closing of the chambers as presented with a straight guide track.

Thus the guide path resulting from the magnetic coupling of the first magnetic guide feature 652 and the second magnetic guide feature 650 defines the rate of change of displacement of the rotor 616 relative to the piston 622, enabling a profound effect on the mechanical reward between the rotation and pivoting of the rotor 616.

Figure 20:
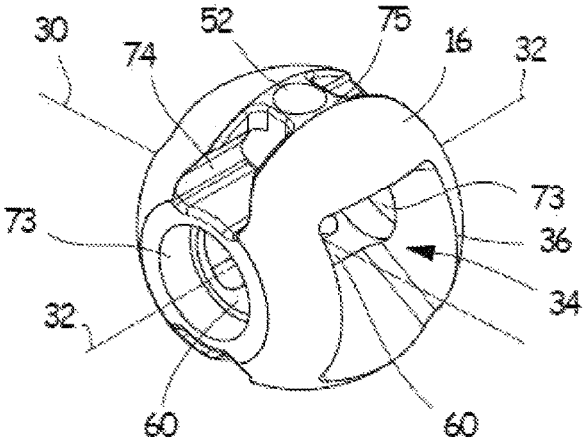
FIG. 20 shows an example of a rotor.

FIG. 20 shows another non limiting example of a rotor 16, akin to that shown in FIGS. 1 to 19. Bearing lands 73 are shown for receiving a bearing assembly (e.g. a roller bearing arrangement), or providing a bearing surface, to carry the rotor 16 on the axle 20. Also shown is a "cut out" feature 74 provided as a cavity in a non-critical region of the rotor, which lightens the structure (i.e. provides a weight saving feature) and provides a land to grip/clamp/support the rotor 16 during manufacture. An additional land 75 adjacent the first magnetic guide feature 52 may also be provided to grip/clamp/support the rotor 16 during manufacture. In this example the first magnetic guide feature 52 is flush with the surface of the rotor 16, but in other examples, the surface of the first magnetic guide feature 52 may project from the surface of the rotor 16. In use, the first magnetic guide feature 52 is magnetically coupled with the second magnetic guide path 50, and will travel along, the guide path, rotating as it moves along the track.

Figure 21:
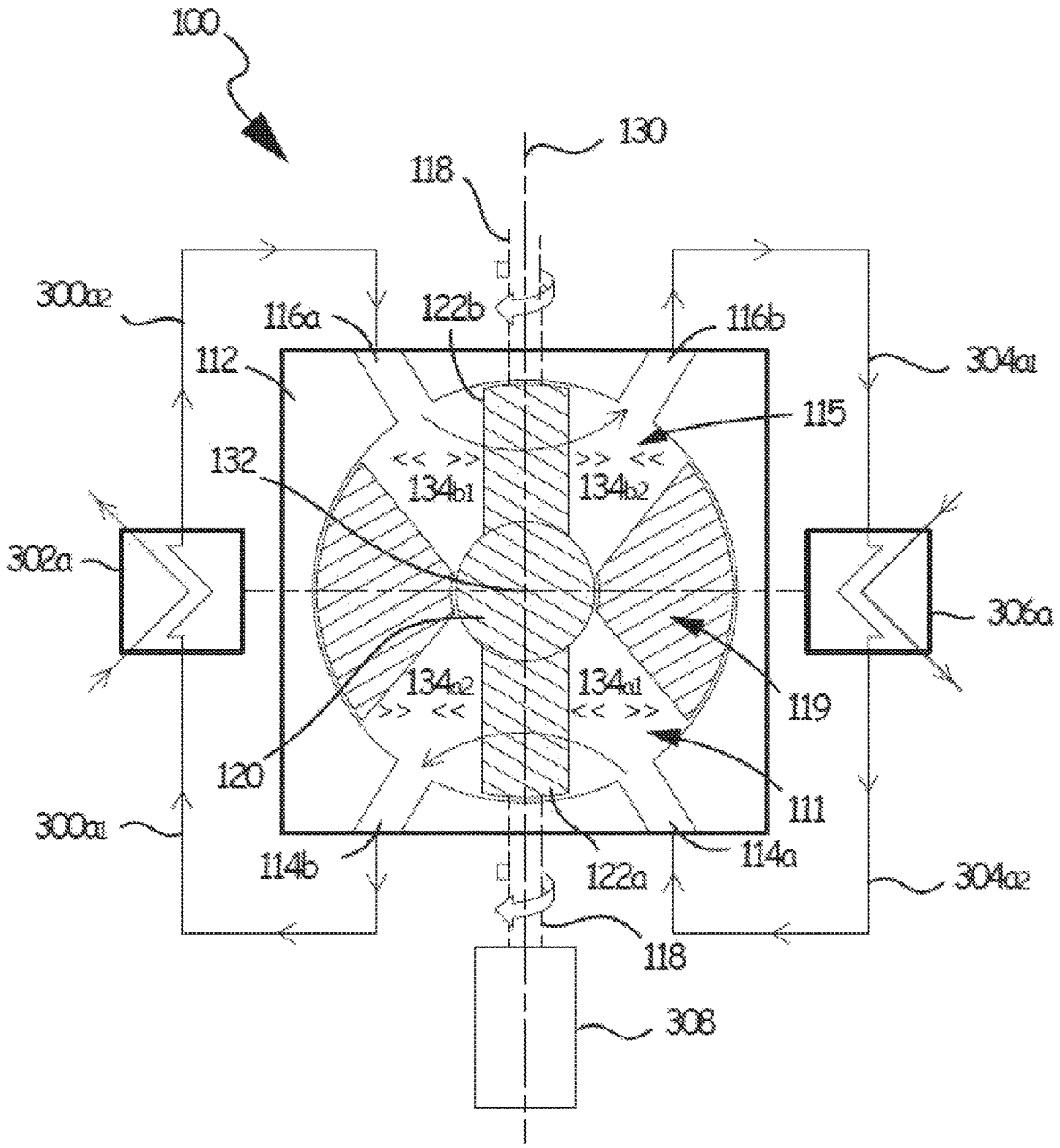
FIG. 21 shows a first example of a closed loop heat pump according to the present disclosure suitable for a refrigeration apparatus.
Figure 22:
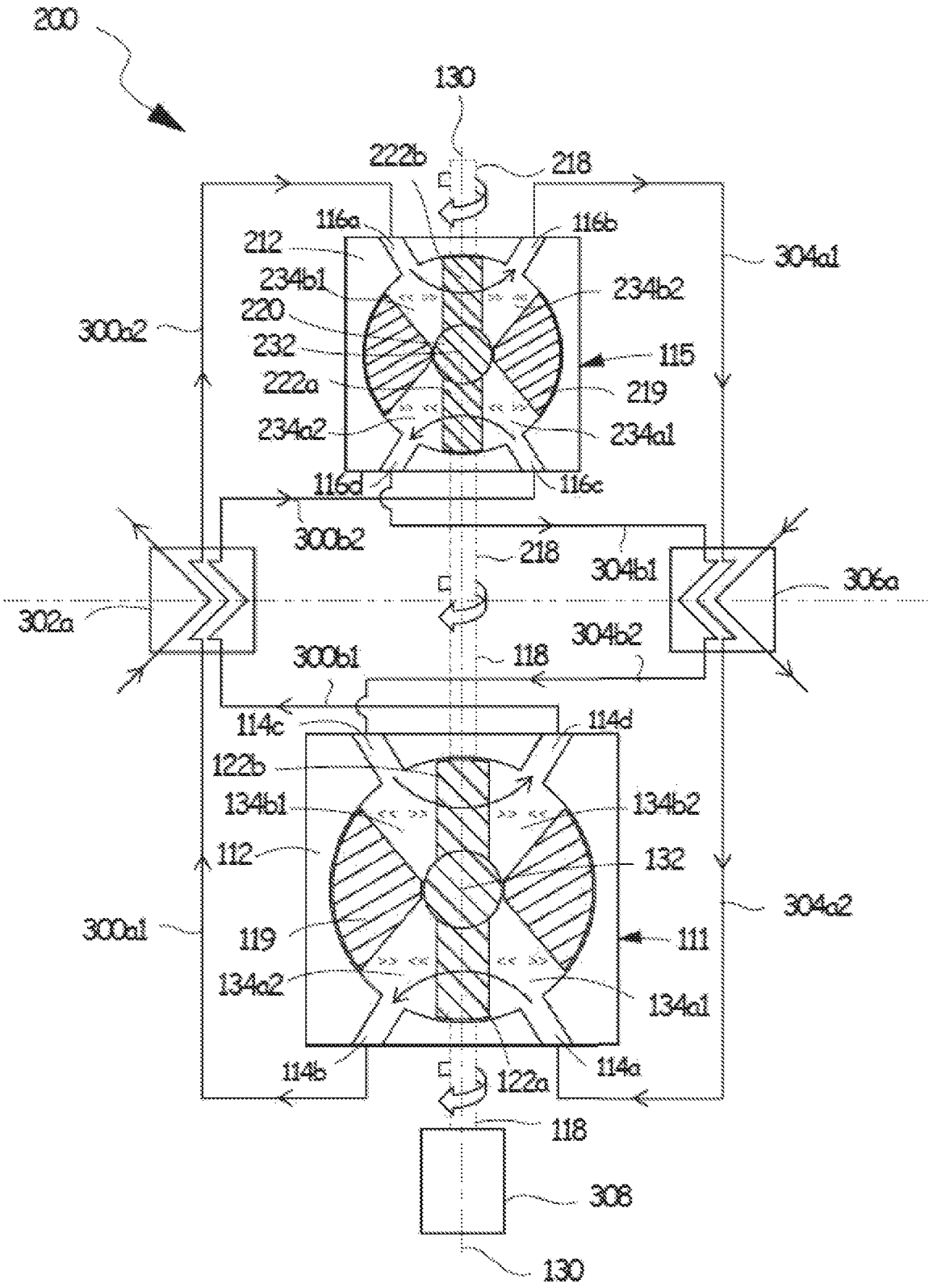
FIG. 22 shows a second example of a closed loop heat pump according to the present disclosure suitable for a refrigeration apparatus.
Figure 25:
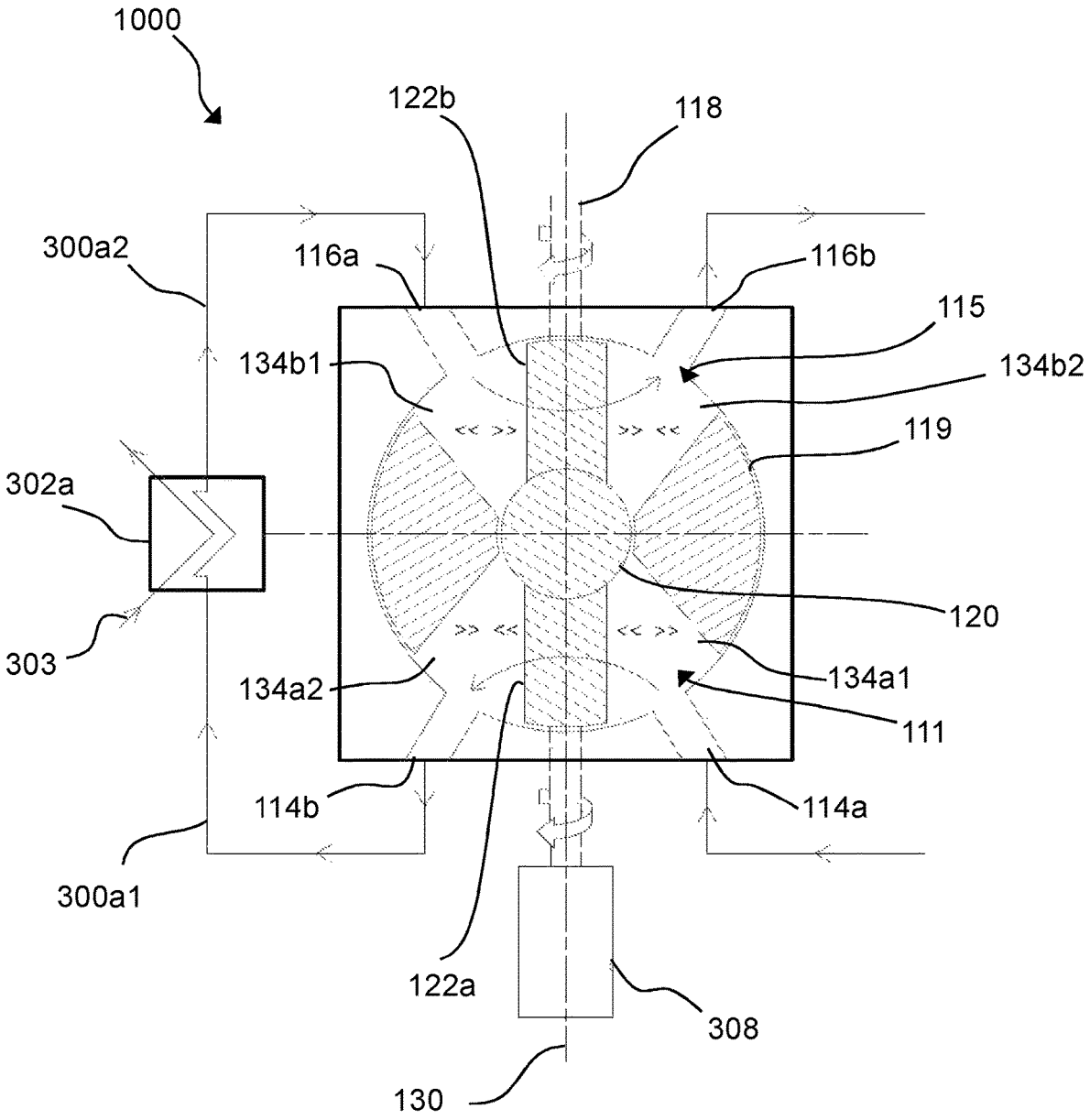
FIG. 25 shows an example of an open loop heat pump according to the present disclosure suitable for a refrigeration apparatus.

FIGS. 21, 22 and 25 illustrate how the rotor apparatus of FIGS. 1 to 19 may be adapted to operate as a roticulating apparatus. Common terminology is used to identify common features, although in order to distinguish between features of the examples, alternative reference numerals are used as appropriate.

Example 1—Single Unit, Closed Loop, Heat Pump

FIG. 21 illustrates an apparatus 100 according to the present disclosure arranged as a closed loop heat pump, for example a refrigeration unit.

As described with reference to FIGS. 1 to 20, the apparatus 100 comprises a first shaft portion 118 (akin to shaft 18) which defines, and is rotatable about, a first rotational axis 130 (akin to rotational axis 30). A first axle 120 (akin to axle 20) defines a second rotational axis 132 (akin to rotational axis 32), the first shaft portion 118 extending through the first axle 120. The second rotational axis 132 is substantially perpendicular to the first rotational axis 130. A first piston member 122*a* (akin to first piston member 22) is provided on the first shaft portion 118, the first piston member 122*a* extending from the first axle 120 towards a distal end of the first shaft portion 118. A first rotor 119 (akin to rotor 16, 516, 616 in FIGS. 1 to 20) is carried on the first axle 120. A housing 112 (akin to housing 12) is provided around the rotor 119 assembly.

The first rotor 119 comprises a first chamber 134*a* (akin to first chamber 34*a*), the first piston member 122*a* extending across the first chamber 134*a*. A wall of the housing 112 is provided adjacent the first chamber 134*a*.

Provided in the wall of the housing 112, and adjacent the first chamber 134*a*, is a first port 114*a* and a second port 114*b* (i.e akin to ports 40, 42). The ports 114*a*, 114*b* are in flow communication with the first chamber 134*a*, and are operable as flow inlets/outlets.

The first chamber 134*a* is divided into sub-chambers 134*a*1, 134*a*2 (akin to sub-chambers 34*a*1, 34*a*2), each on opposite sides of the piston 122*a*. Hence at any one time, the ports 114*a*, 114*b* may be in flow communication with one of the sub-chambers 134*a*1, 134*a*2, but not both.

The first rotor 119 comprises a second chamber 134*b* (akin to second chamber 34*b*). A wall of the housing 112 is provided adjacent the second chamber 134*b*. The housing 112 comprises a third port 116*a* and fourth port 116*b*, which are in flow communication with the second chamber 134*b*. The ports 116*a*, 116*b* are in flow communication with the first chamber 134*b*, and are operable as flow inlets/outlets.

The second chamber 134*b* is divided into sub-chambers 134*b*1, 134*b*2 (akin to sub-chambers 34*b*1, 34*b*2), each on opposite sides of the piston 122*b*. Hence at any one time, the ports 116*a*, 116*b* may be in flow communication with one of the sub-chambers 134*b*1, 134*b*2, but not both.

The first piston member 122*a* extends from one side of the first axle 120 along the first shaft portion 118, and a second piston member 122*b* (akin to second piston member 22) extends from the other side of the first axle 120 along the first shaft portion 118, across the second chamber 134*b*. Thus, as described in relation to the examples of FIGS. 1 to 14, the arrangement is configured to permit relative pivoting motion between the first rotor 119 and the second piston member 122*b* as the first rotor 119 rotates about the first rotational axis 130.

The first shaft portion 118, first axle 120 and first piston member(s) 122*a*, 122*b* may be fixed relative to one another.

Thus the first rotor 119 and first axle 120 are rotatable with the first shaft portion 118 around the first rotational axis 130, and the first rotor 119 is pivotable about the axle 120 about the second rotational axis 132 to permit relative pivoting motion between the first rotor 119 and the first piston member 122*a* as the first rotor 119 rotates about the first rotational axis 130.

The second port 114*b* is in fluid communication with the third port 116*a* via a first duct/conduit 300*a* which comprises a first heat exchanger 302*a*. The first heat exchanger 302*a* is operable to remove heat energy from working fluid passing through it. That is to say, the first heat exchanger 302*a* is a heat sink for the working fluid (i.e. a heat sink for the medium or media flowing through the system). A first section 300*a*1 of duct 300*a* connects the second port 114*b* to the first heat exchanger 302*a*, and a second section 300*a*2 of duct 300*a* connects the first heat exchanger 302*a* to third port 116*a*. That is to say, a fluid in a duct/conduit 300*a* may pass through the first heat exchanger 302.

Hence the first chamber 134*a*, heat exchanger 302*a* and second chamber 134*b* are arranged in flow series.

The fourth port 116*b* is in fluid communication with the first port 114*a* via a second duct (or conduit) 304*a* which comprises a second heat exchanger 306*a*. The second heat exchanger 306*a* is operable to add heat energy from working fluid passing through it. That is to say, the second heat exchanger 306*a* is a heat source for the working fluid (i.e. a heat source for the medium or media flowing through the system).

The first heat exchanger 302*a* may be provided as any suitable heat sink (for example in thermal communication with a volume to be heated, a river, ambient air etc). The second heat exchanger 306*a* may comprise or be in thermal communication with any suitable heat source (for example, a volume to be cooled, the internal air of a food store etc).

A first section 304*a*1 of duct 304*a* connects the fourth port 116*b* to the second heat exchanger 306*a*, and a second section 304*a*2 of duct 304*a* connects the second heat exchanger 306*a* to the first port 114*a*.

The magnetic coupling of the first magnetic guide feature 52 and the second magnetic guide feature 50 induces a rotational force to drive the rotor 119 around the first rotational axis 130. In some examples, a motor 308 is coupled to the first shaft portion 118 to provide additional drive for the rotor 119 around the first rotational axis 130, but this may not be required, in use.

In the present example, the first chamber 134*a* and piston 122*a* hence provide a first fluid flow section 111, which in this example are operable as a compressor or displacement pump. Hence the first fluid flow section 111 is configured for the passage of fluid between the first port 114*a* and second port 114*b* via the first chamber 134*a*.

Also the second chamber 134*b* and piston 122*b* hence provide a second fluid flow section 115, which in this example are operable as a metering section or expansion section. Hence the second fluid flow section 115 is configured for the passage of fluid between the third port 116*a* and fourth port 116*b* via the second chamber 134.

The volumetric capacity of the first rotor second chamber 134*b* may be substantially the same, less, or greater than the volumetric capacity of the first rotor first chamber 134*a*.

That is to say, in the present example, the volumetric capacity of the second fluid flow section 115 may be the same, less, or greater than the volumetric capacity of the first fluid flow section 111.

For example the volumetric capacity of the first rotor second chamber 134*b* may be at most half the volumetric capacity of the first rotor first chamber 134*a*.

Alternatively the volumetric capacity of the first rotor second chamber 134*b* may be at least twice the volumetric capacity of the first rotor first chamber 134*a*.

Hence in the present example, this provides an expansion ratio within the confines of a single device.

This may be achieved by providing the first rotor first chamber 134*a* as a different width than the first rotor second chamber 134*b*, with the first piston 122*a* consequentially having a different width than the second piston 122*b*. Hence although the pistons will pivot, and hence travel, to the same extent around the second rotational axis 132, the volume of the chambers 134*a*, 134*b* and swept volume of the pistons 122*a*, 122*b* will differ.

As shown in FIG. 17, which shows just the rotor assembly 116, the different volumes may be achieved by providing the first rotor first chamber 134*a* as wider than the first rotor second chamber 134*b*, with the first piston 122*a* consequentially being wider than the second piston 122*b*. Hence although the pistons will pivot, and hence travel, to the same extent around the second rotational axis 132, the volume of the chamber 134*a* will be greater than the volume of chamber 134*b*, and hence the swept volume of the piston 122*a* will be greater than piston 122*b*.

In operation (as described later) a working fluid is introduced into and cycles around the system.

The fluid may be a refrigerant fluid or other media, for example, but not limited to, Ethanol, R22 or Super saturated $CO_2$.

Given the system is essentially closed, the working fluid may not be consumed or rendered inoperable after each cycle. That is to say, for the majority of its operation the same fixed volume of working fluid will remain and continually cycle around the system. In alternative examples, the working fluid may be partly or wholly replaced during operation of the device (for example during each cycle, or after a predetermined number of cycles).

Since the first fluid flow section 111 (in this example a displacement/compressor/pump section) and second fluid flow section 115 (in this example an metering/expansion section) are two sides of the same rotor, the rotation of the rotor 119 is driven both by the motor and the metering/expansion of the fluid in the second chamber 134*b* (i.e. in sub-chambers 134*b*1, 134*b*2). Thus the configuration of the device of the present disclosure recovers some of the energy from the expansion phase to partly drive the rotor 119.

Operation of the device 100 will now be described.

Stage 1

In the example as shown in FIG. 21 the working fluid enters the sub-chamber 134*a*1 via port 114*a*.

The working fluid is then pumped (e.g. compressed) by the action of the piston 122*a*, driven by the magnetic coupling of the first magnetic guide feature 52 and the second magnetic guide feature 50, in the sub-chamber 134*a* and exits via the second port 114*b*.

At the same time as working fluid is being drawn into the sub-chamber 134*a*1, working fluid is being exhausted from sub-chamber 134*a*2 through the second port 114*b*.

At the same time as working fluid is being exhausted from the sub-chamber 134*a*1, working fluid is being drawn into sub-chamber 134*a*2 through the first port 114*b*.

Stage 2

In the example as shown in FIG. 21, after being exhausted from the first chamber 134*a* of rotor 119, working fluid travels along duct 300*a*1 and enters the first heat exchanger 302*a*, which is configured as a heat sink. Hence heat is extracted from the working fluid as it passed through the first heat exchanger 302*a*.

Depending on the nature of the working fluid, there may be a phase change of the working fluid in the first heat exchanger 302*a*.

Stage 3

In the example as shown in FIG. 21 the working fluid travels along duct 300*a*2 and enters the sub-chamber 134*b*1 of the rotor via the third port 116*a* where it its pressure is restrained and the working fluid is metered into duct 304*a* via the fourth port 116*b*.

At the same time as working fluid is entering sub-chamber 134*b*1, working fluid is being exhausted from sub-chamber 134*b*2 via the fourth port 116*b*.

As the rotor 119 continues to rotate, the working fluid is exhausted from the sub-chamber 134*b*1 via the fourth port 116*b*, and more working fluid enters the sub-chamber 134*b*2 via the third port 116*a* where it expands.

In all examples, sequential expansion of the working fluid in the rotor sub-chambers 134*b*1, 134*b*2 induces a force to thereby (at least in part) cause pivoting of the rotor about its second rotational axis, and to cause rotation of the rotor about its first rotational axis. This force is in addition to that provided by the magnetic coupling of the first magnetic guide feature 52 and the second magnetic guide feature 50.

Stage 4

In the example as shown in FIG. 21 working fluid then travels from the second chamber 134*b* along duct 304*a*1 and enters the second heat exchanger 306*a*, which in this example is configured as a heat source.

Depending on the nature of the working fluid, there may be a phase change of the working fluid in the second heat exchanger 306*a*.

Hence the working fluid absorbs heat from the heat source and then leaves the second heat exchanger 306*a* and travels along duct 304*a*2 before entering the first chamber 134*a* to re-start the cycle.

Example 2—Double Unit, Closed Loop, Heat Pump

FIG. 22 illustrates another example of a closed loop heat pump, for example a refrigeration unit. This example includes many features in common with, or equivalent to, the example of FIG. 21, and are hence referred to with the same reference numerals.

Hence the apparatus 200 comprises a first fluid flow section 111 which, akin to the example of FIG. 15 may be operable as a compressor or displacement pump. The first fluid flow section 111 has a first port 114*a* and a second port 114*b*, which are operable as flow inlets/outlets.

It also comprises a second fluid flow section 115 which, akin to the example of FIG. 15, may be operable as a metering section or expansion section. The second fluid flow section 115 has a third port 116*a* and a fourth port 116*b*, which are operable as flow inlets/outlets.

The apparatus 200 comprises a first shaft portion 118 which defines and is rotatable about a first rotational axis 130. A first axle 120 defines a second rotational axis 132, the first shaft portion 118 extending through the first axle 120. The second rotational axis 132 is substantially perpendicular to the first rotational axis 130. A first piston member 122*a* is provided on the first shaft portion 118, the first piston member 122*a* extending from the first axle 120 towards a distal end of the first shaft portion 118. A first rotor 119 is carried on the first axle 120. The first rotor 119 comprises a first chamber 134*a*, the first piston member 122*a* extending across the first chamber 134*a*. The first displacement outlet 113*a* and first displacement inlet 114*a* are in flow communication with the first chamber 134*a*.

The first shaft portion 118, first axle 120 and first piston member(s) 122*a*, 122*b* may be fixed relative to one another.

Also the first rotor 119 comprises a second chamber 134*b*. The first piston member 122*a* extends from one side of the first axle 120 along the first shaft portion 118 through the first chamber 134*a* to define sub-chambers 134*a*1, 134*a*2, and a second piston member 122*b* extends from the other side of the first axle 120 along the first shaft portion 118, across the second chamber 134*b* to define sub-chambers 134*b*1, 134*b*2. Hence the arrangement is configured to permit relative pivoting motion between the first rotor 119 and the second piston member 122*b* as the first rotor 119 rotates about the first rotational axis 130.

Thus, as described in relation to the examples of FIGS. 1 to 20, the first rotor 119 and first axle 120 are rotatable with the first shaft portion 118 around the first rotational axis 130, and the first rotor 119 is pivotable about the axle 120 about the second rotational axis 132 to permit relative pivoting motion between the first rotor 119 and the first piston member 122*a* and second piston member 122*b* as the first rotor 119 rotates about the first rotational axis 130.

The apparatus 200 further comprises a second shaft portion 218 rotatable about the first rotational axis 130 and coupled to the first shaft portion 118 such that the first shaft portion 118 and second shaft portion 218 are rotatable together around the first rotational axis 130.

A second axle 220 defines a third rotational axis 232, the second shaft portion 218 extending through the second axle 220. The third rotational axis 232 is substantially perpendicular to the first rotational axis 130 and parallel to the second rotational axis 132 of the first rotor, and would hence extend out of/into the page as shown in FIG. 22.

A second rotor 219 is carried on the second axle 220. The first shaft portion 118 is directly coupled to the second shaft portion 218 such that the first rotor 119 and second rotor are operable to only rotate at the same speed as each other. A second housing 212 (akin to housing 12) is provided around the second rotor 219.

Similar to first rotor 119, the second rotor 219 comprises a first chamber 234*a* and a second chamber 234*b*. A second piston member 222*b* is provided on the second shaft portion 218, the second piston member 222*b* extending from the second axle 220 across the second chamber 234*b* towards a distal end of the second shaft portion 218 to define sub-chambers 234*b*1, 234*b*2.

The second piston member 222*b* extends from one side of the second axle 220 along the second shaft portion 218. A second rotor first piston member 222*a* extends from the other side of the second axle 220 along the second shaft portion 218, across the first chamber 234*a* to define sub-chambers 234*a*1, 234*a*2. Thus, as described in relation to the examples of FIGS. 1 to 14, the arrangement is configured to permit relative pivoting motion between the second rotor 219 and the first and second piston members 222*a*, 222*b* as the second rotor 219 rotates about the first rotational axis 130.

The second shaft portion 218, second axle 220 and second piston member(s) 222*a*, 222*b* may be fixed relative to one another.

In this example the third port 116*a* and fourth port 116*b* are in flow communication with the second chamber 234*b*, the third port 116*a* and fourth port 116*b* being provided in a wall of housing 212 of the second rotor.

Hence the second rotor 219 and second axle 220 are rotatable with the second shaft portion 218 around the first rotational axis 130, and the second rotor 219 is pivotable about the second axle 220 about the third rotational axis 232 to permit relative pivoting motion between the second rotor 219 and the first and second piston members 222*a*, 222*b* as the second rotor 219 rotates about the first rotational axis 130.

The second port 114*b* of the first rotor 119 is in fluid communication with the third port 116*a* of the second rotor 219 via a first duct/conduit 300*a* which comprises a first heat exchanger 302*a*. In common with the example of FIG. 21, the first heat exchanger 302*a* is operable to remove heat energy from working fluid passing through it (i.e. is a heat sink). A first section 300*a*1 of duct 300*a* connects the second port 114*b* to the first heat exchanger 302*a*, and a second section 300*a*2 of duct 300*a* connects the first heat exchanger 302*a* to the third port 116*a*.

The first rotor second chamber 134*b* is in flow communication with a fifth port 114*c* and a sixth port 114*d* provided in a wall of the first housing 112, such that the arrangement is configured for the passage of fluid between the fifth port 114*c* and sixth port 114*d* via the first rotor second chamber 134*b*.

The second rotor first chamber 234*a* is in flow communication with a seventh port 116*c* and an eighth port 116*d* provided in a wall of the second housing 212, such that the arrangement is configured for the passage of fluid between the seventh port 116*c* and eighth port 116*d* via the second rotor first chamber 234*a*.

The sixth port 114*d* of the first rotor 119 is in fluid communication with the seventh port 116*c* of the second rotor 219 via a second duct/conduit 300*b* which comprises (i.e. extends through) the first heat exchanger 302*a*. A first section 300*b*1 of duct 300*b* connects the sixth port 114*d* to the first heat exchanger 302*a*, and a second section 300*b*2 of duct 300*b* connects the first heat exchanger 302*a* to the seventh port 116*c*.

The fourth port 116*b* of the second rotor 219 is in fluid communication with the first port 114*a* of the first rotor 119 via a second duct/conduit 304*a* which comprises a second heat exchanger 306*a*. In common with the example of FIG. 21, the second heat exchanger 306*a* is operable to add heat energy to the working fluid passing through it (i.e. is a heat source). A first section 304*a*1 of duct 304*a* connects the fourth port 116*b* to the second heat exchanger 306*a*, and a second section 304*a*2 of duct 300*a* connects the second heat exchanger 306*a* to the first port 114*a*.

The eight port 116*d* of the second rotor 219 is in fluid communication with the fifth port 114*c* of the first rotor via a second duct/conduit 304*b* which comprises (i.e. extends through) the second heat exchanger 306*a*. A first section 304*b*1 of duct 304*b* connects the eighth port 116*d* to the second heat exchanger 306*a*, and a second section 304*b*2 of duct 304*b* connects the second heat exchanger 306*a* to the fifth port 114*c*.

Hence there are two fluid flow circuits in this example (e.g. between the first rotor first chamber 134*a* and second rotor second chamber 234*b*, and between the first rotor second chamber 134*b* and second rotor first chamber 234*a*) which may be fluidly isolated from one another. The working fluid may be the same as described in relation to the FIG. 21 example.

In the present example, the first rotor 119 assembly (i.e. the first rotor chambers 134*a*, 134*b* and first rotor pistons 122*a*, 122*b*) and first housing 112 hence provide the first fluid flow section 111, which in this example are operable as a compressor or displacement pump. Hence the first fluid flow section 111 is configured for the passage of fluid between the first port 114*a* and second port 114*b* via the first rotor first chamber 134*a*, and for the passage of fluid between the fifth port 114*c* and sixth port 114*d* via the first rotor second chamber 134*b*.

Also the rotor 219 assembly (i.e. second rotor chambers 234*a*, 234*b* and first rotor pistons 222*a*, 222*b*) and second housing 212 hence provide the second fluid flow section 115, which in this example are operable as a metering section or expansion section. Hence the second fluid flow section 115 is configured for the passage of fluid between the third port 116*a* and fourth port 116*b* via the second rotor second chamber 234*b*, and for the passage of fluid between the seventh port 116*c* and eighth port 116*d* via the second rotor first chamber 234*a*, As shown in FIG. 22, the first chamber 134*a* and second chamber 134*b* of the first rotor 119 (i.e. first fluid flow section 111) have substantially the same volumetric capacity as each other. The first chamber 234*a* and second chamber 234*b* of the second rotor 219 (i.e. the second fluid flow section 115) have substantially the same volumetric capacity as each other. However, the volumetric capacity of the first rotor chambers 134*a*, 134*b* (first fluid flow section 111) may be substantially the same, less, or greater than the volumetric capacity of the second rotor chambers 234*a*, 234*b* (second fluid flow section 115).

That is to say, in the present example, the volumetric capacity of the rotor chambers 234*a*, 234*b* of the second fluid flow section 115 may be the same, less, or greater than the volumetric capacity of the rotor chambers 134*a*, 134*b* first fluid flow section 111.

That is to say, in the present example, the volumetric capacity of the second fluid flow section 115 may be at most half the volumetric capacity of the first fluid flow section 111.

Alternatively, in the present example, the volumetric capacity of the second fluid flow section 115 may be at least twice the volumetric capacity of the first fluid flow section 111.

Figure 24:
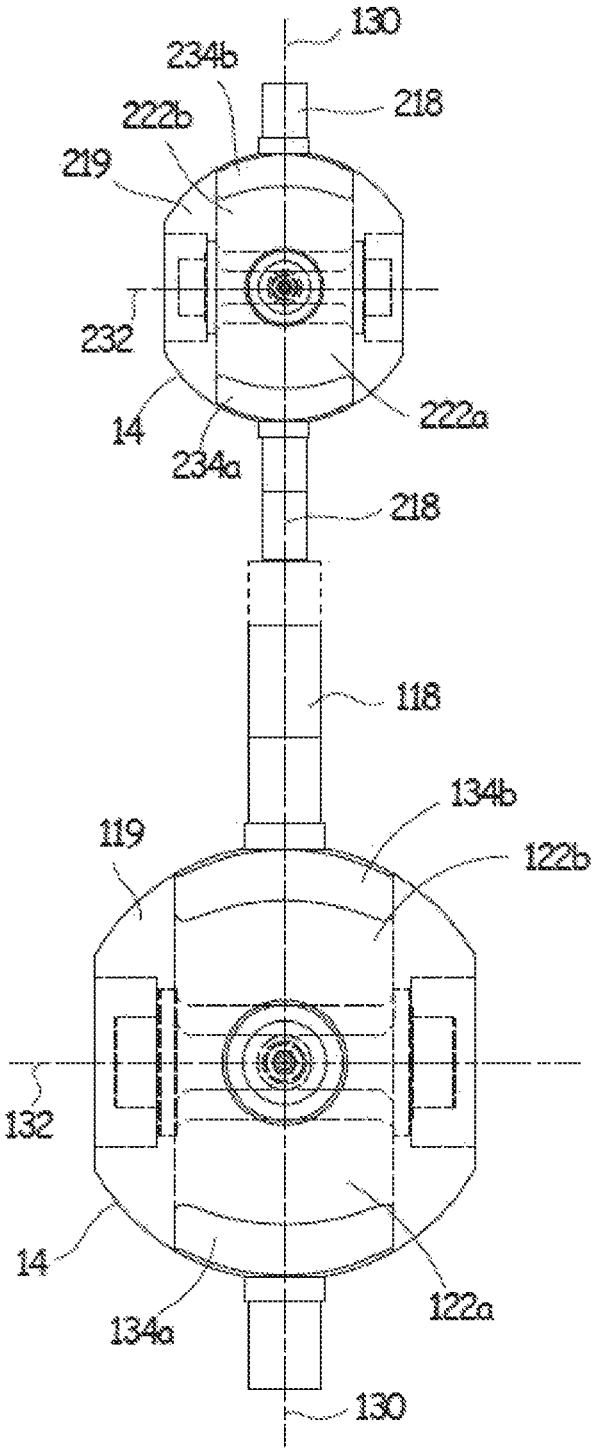

As shown in FIG. 24, which shows just the rotors 119, 219, pistons 122, 222 and shafts 118, 218, the difference in volumetric capacity may be achieved by providing the first rotor chambers 134*a*, 134*b* as wider than the second rotor chambers 234*a*, 234*b*, with the first rotor pistons 122*a*, 122*b* consequentially being wider than the second rotor pistons 222*a*, 222*b*. Hence although the pistons 122, 222 may pivot by the same angle, the volume of the first chambers 134*a*, 134*b* will be greater than the second chambers 234*a*, 234*b*, and the swept volume of the first rotor pistons 122*a*, 122*b* will be greater than the swept volume of the second rotor pistons 222*a*, 222*b*.

Since the shaft 118 of the first fluid flow section 111 (first rotor 119) and shaft 218 of the first fluid flow section 115 (second rotor 219) are coupled so they rotate together, the rotation of the first rotor 119 is driven both by the magnetic coupling of the first magnetic guide feature 52 and the second magnetic guide feature 50 and the expansion of the fluid in the sub-chambers 234*a*1, 234*a*2, 234*b*1, 234*b*2 of the second rotor 219.

In other examples the first rotor shaft 118 and second rotor shaft 218 are integrally formed as one, and extend through both rotors 119, 219.

Operation of the device 200 will now be described.

Stage 1

In the example as shown in FIG. 22 the working fluid enters the sub-chambers 134*a*1, 134*b*1 via the first port 114*a* and fifth port 114*c* respectively.

The working fluid is then pumped (e.g. compressed) by the action of the respective pistons 122*a*, 122*b* driven by the magnetic coupling of the first magnetic guide feature 52 and the second magnetic guide feature 50 induces a rotational force to drive the rotor 119 around the first rotational axis 130, in the sub-chambers 134*a*, 134*b* and exits via the second port 114*b* and sixth port 114*d* respectively.

At the same time as working fluid is being drawn into the sub-chambers 134*a*1, 134*b*1, working fluid is being exhausted from sub-chambers 134*a*2, 134*b*2 through the second port 114*b* and sixth port 114*d* respectively.

At the same time as working fluid is being exhausted from the sub-chambers 134*a*1, 134*b*1, working fluid is being drawn into sub-chambers 134*a*2, 134*b*2 through the first port 114*a* and fifth port 114*c* respectively.

Stage 2

In the example as shown in FIG. 22, after being exhausted from the first rotor chambers 134*a*, 134*b*, working fluid travels along ducts 300*a*1, 300*b*1 respectively and enters the first heat exchanger 302*a*, which is configured as a heat sink. Hence heat is extracted from the working fluid as it passed through the first heat exchanger 302*a*.

Depending on the nature of the working fluid, there may be a phase change of the working fluid in the first heat exchanger 302*a*.

Stage 3

In the example as shown in FIG. 22 the working fluid travels along ducts 300*a*2, 300*b*2 and enters the sub-chambers 234*b*1, 234*a*1 of the second rotor via the third port 116*a* and seventh port 116*c* respectively where its pressure is restrained and the working fluid is metered into ducts 304*a*1, 304*b*1 respectively via the fourth port 116*b* and eighth port 116*d* respectively.

At the same time as working fluid is entering sub-chambers 234*b*1, 234*a*1, working fluid is being exhausted from sub-chambers 234*b*2, 234*a*2 via the fourth port 116*b* and eighth port 116*d* respectively.

As the second rotor 219 continues to rotate, the working fluid is exhausted from the sub-chambers 234*b*1, 234*a*1 via the fourth port 116*b* and eighth port 116*d*, and more working fluid enters the sub-chambers 234*b*2, 234*a*2 via the third port 116*a* and seventh port 116*c*.

In all examples, sequential delivery and behaviour of the working fluid in the rotor sub-chambers 234*a*1, 234*a*2, 234*b*1, 234*b*2 induces a force to thereby (at least in part) cause pivoting of the second rotor 219 about its second rotational axis 232, and to cause rotation of the rotor about its first rotational axis. This force is in addition to that provided by the magnetic coupling of the first magnetic guide feature 52 and the second magnetic guide feature 50.

Stage 4

In the example as shown in FIG. 22 working fluid then travels from the second rotor chambers 234*a*, 234*b* along ducts 304*a*1, 304*b*1 and enters the second heat exchanger 306*a*, which in this example is configured as a heat source.

Depending on the nature of the working fluid, there may be a phase change of the working fluid in the second heat exchanger 306*a*.

Hence the working fluid absorbs heat from the heat source and then leaves the second heat exchanger 306*a* and travels along ducts 304*a*2, 304*b*2 before entering the first rotor chambers 134*a*, 134*b* to re-start the cycle.

Example Variants of Double Units

In an alternative double unit examples, for example variants of Example 2 (FIG. 22), the first rotor first chamber 134*a* may have a volumetric capacity substantially less than or substantially greater than the volumetric capacity of the first rotor second chamber 134*b*. Additionally or alternatively, the second rotor second chamber 234*b* may have a volumetric capacity substantially less than or substantially greater than the volumetric capacity of the second rotor first chamber 234*a*.

For example, the first rotor first chamber 134*a* may have a volumetric capacity of at most half or at least twice the volumetric capacity of the first rotor second chamber 134*b*. Additionally or alternatively, the second rotor second chamber 234*b* may have a volumetric capacity of at most half or at least twice the volumetric capacity of the second rotor first chamber 234*a*.

Such an example provides a multi stage device, or two working fluid circuits with different expansion ratios through a common system.

Ducts 300*a*, 300*b* and ducts 304*a*, 304*b* have been illustrated as discrete circuits. However duct 300*a* and duct 300*b* may, at least in part, be combined to define a common flow path which passes through heat exchanger 302. Likewise duct 304*a* and duct 304*b* may, at least in part, be combined to define a common flow path which passes through heat exchanger 306. Alternatively the ducts 300*a*, 300*b* may pass through entirely separate heat exchanger units 302 having different, or the same, heat capacities as each other. Likewise alternatively the ducts 304*a*, 304*b* may pass through entirely separate heat exchanger units 306 having different, or the same, heat capacities as each other.

In the preceding examples, drive shafts 118, 218 are described as being rigidly/directly linked and so they operate at the same rotational speed as each other to provide lossless operation between them. However, in an alternative example the first shaft 118 and second shaft 218 may be coupled by mechanical (for example by a gear box) or virtual means (for example by an electronic control system) so they may rotate at different speeds relative to one another.

The core of the apparatus of the present disclosure is a true positive displacement unit which offers up to a 100% internal volume reduction per revolution. It is operable to simultaneously 'push' and 'pull' the piston 122 across its chamber, so for example, in the same chamber can create a full vacuum on one side of a piston whilst simultaneously producing compression and/or displacement on the other.

Coupling of the displacement section and expansion sections (i.e. direct drive between the first fluid flow section 111 and second fluid flow section 115, whether part of the same rotor as shown in FIGS. 21, 25, or linked rotors as shown in FIG. 22,) means that mechanical losses are minimised relative to examples of the related art, as well as enabling recovery from the processes in each section to help drive the other side.

Hence significantly higher expansion or compression ratios are achievable than with examples of the related art. For example, a single stage expansion or compression in excess of 10:1 is achievable, which is significantly greater than with examples of the related art.

Positive displacement using both continuous (and simultaneous) expansion and displacement/compression on opposing faces of a single piston provides for a device which is inherently more efficient than devices of the related art.

This also means the device can perform efficient operation under varied loads and varied speeds, which is not possible with a conventional arrangement (for example those including an axial flow turbine). This allows for harvesting of energy at input levels not previously achievable.

The apparatus of the present invention can be scaled to any size to suit different capacities or power requirements, its dual output drive shaft also makes it easy to mount multiple drives on a common line shaft, thereby increasing capacity, smoothness, power output, offering redundancy, or more power on demand. Hence a heat engine device of the present disclosure could be carried on a vehicle to provide additional drive or electrical generation to supplement the output of a larger engine with little weight penalty.

The device inherently has an extremely low inertia which offers low load and quick and easy start-up.

With respect to the heat pumps (examples 1, 3) of FIGS. 21, 25 and heat engines (example 2) of FIG. 22, these arrangements are especially advantageous as they are inherently thermodynamically reversible. Hence the devices may operate with working fluids at different phases (for examples in different phases) in either direction. Thus apparatus according to the present invention are more applicable to a wider range of uses than devices of the related art.

Thus there is provided a mechanically simple and scalable apparatus for refrigeration or generation purposes. Additionally, such heat pumps or heat engines according to the present disclosure may be highly efficient in either mode of operation.

With respect to the heat engine (Examples 2) of FIG. 22, the apparatus of the present disclosure provides a technical solution with a high thermodynamic efficiency, which can operate at low speed. Operation at low speed is advantageous as it enables electricity generation at speeds closer to or at the required frequency, thereby reducing reliance, and losses due to, gearing and signal inversion.

The rotor 14 and housing 12 may be configured with a small clearance between them thus enabling oil-less and vacuum operation, and/or obviate the need for contact sealing means between rotor 16 and housing 12, thereby minimising frictional losses. Frictional losses are further reduced by the use of the first magnetic guide feature 52 and the second magnetic guide feature 50, which obviate the need of a bearing roller to guide the rotor 16.

In some example, the first magnetic guide feature 52 and the second magnetic guide feature 50 are magnetically coupled to provide sufficient force to propel the rotor 16 and to perform the guidance to keep the rotor on the desired guide path.

Where applications which would benefit from such, the shaft 18, 118, 218 may extend out of both sides of the rotor housing to be coupled to a powertrain for driving device and/or an electrical generator.

Example 9—Single Unit, Open Loop, Air Cycle

FIG. 25 illustrates an example of an open loop air cycle apparatus 1000 according to the present disclosure, which includes many features in common, or equivalent to, the example of FIG. 21, and are hence referred to with the same reference numerals.

The system is an open loop, with no connection between the first port 114*a* and the fourth port 116*b*. That is to say, the second duct 304*a* and second heat exchanger 306*a* not present, and hence the first port 114*a* and the fourth port 116*b* are isolated from one another.

The magnetic coupling of the first magnetic guide feature 52 and the second magnetic guide feature 50 induces a rotational force to drive the rotor 119 around the first rotational axis 130. In some examples, a motor 308 is coupled to the first shaft portion 118 to provide additional drive for the rotor 119 around the first rotational axis 130, but this motor may not be required because the rotational force induced from the magnetic coupling of the first magnetic guide feature 52 and the second magnetic guide feature 50 may be sufficient to provide all of the required rotational force.

In the present example, the first chamber 134*a* and piston 122*a* hence provide a first fluid flow section 111, which in this example are operable as a compressor or displacement pump. Hence the first fluid flow section 111 is configured for the passage of fluid between the first port 114*a* and second port 114*b* via the first chamber 134*a*.

Also the second chamber 134*b* and piston 122*b* hence provide a second fluid flow section 115, which in this example are operable as a metering section or expansion section. Hence the second fluid flow section 115 is configured for the passage of fluid between the third port 116*a* and fourth port 116*b* via the second chamber 134.

The first port 114*a* may be in fluid communication with a source of ambient air, for example open to atmosphere. Hence in this example, the working fluid may comprise air. However, in other examples, the fluid may be any suitable fluid.

The first heat exchanger 302*a* may be in thermal communication with any suitable heat source or a substance to be cooled. In one example, a substance, for example a second fluid to be cooled, is passed through a duct 303 in the first heat exchanger 302*a*, such that the substance may transfer heat to the working fluid and the substance is cooled as it passes through the first heat exchanger 302. The substance may be any medium that may flow and be cooled, such as a fluid such as air, gas or liquid. In some examples, the substance is medium for cooling personal climatic conditions, for example to provide temperature control in buildings. In other examples, the substance may be used to cool or heat electronics systems.

Hence, the first heat exchanger 302*a* is a heat source configured to add heat energy to working fluid passing through it.

The volumetric capacity of the first chamber 134*a* may be substantially the same, less, or greater than the volumetric capacity of the second chamber 134*b*.

That is to say, in the present example, the volumetric capacity of the second fluid flow section 115 may be the same, less, or greater than the volumetric capacity of the first fluid flow section 111. In this example, the volumetric capacity of the second fluid flow section 115 is preferably greater than the volumetric capacity of the first fluid flow section 111.

For example the volumetric capacity of the second chamber 134*b* may be at most half the volumetric capacity of the first rotor first chamber 134*a*.

In other examples, the volumetric capacity of the second chamber 134*b* may be at most 20% of the volumetric capacity of the first rotor first chamber 134*a*

Alternatively the volumetric capacity of the first rotor second chamber 134*b* may be at least twice the volumetric capacity of the first rotor first chamber 134*a*.

Alternatively the volumetric capacity of the first rotor second chamber 134*b* may be at least three times the volumetric capacity of the first rotor first chamber 134*a*.

Figure 23:
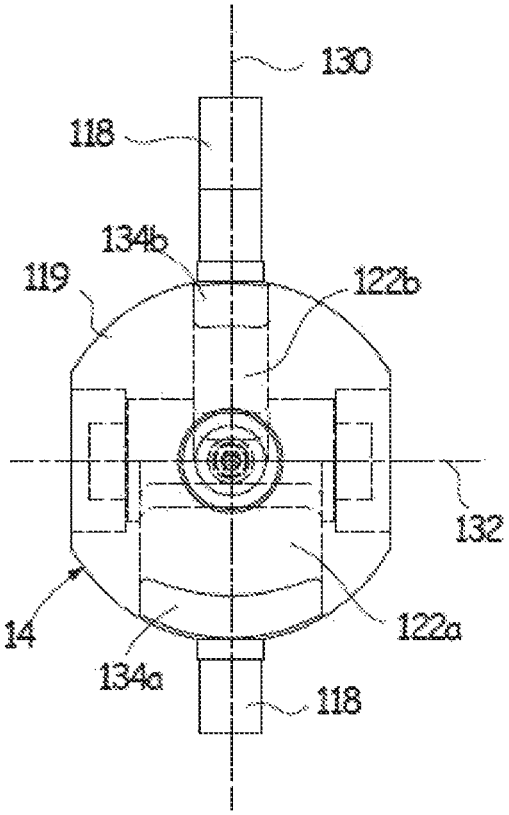
FIGS. 23, 24 show alternative means of providing differential rotor volumes which may form part of the heat pumps of FIGS. 21, 22 respectively, or part of the heat engines of further examples of the present disclosure.

Hence in the present example, this provides an expansion ratio within the confines of a single device (for example as shown in FIG. 23).

This may be achieved by providing the first chamber 134*a* as a different width than the second chamber 134*b*, with the first piston 122*a* consequentially having a different width than the second piston 122*b*. Hence although the pistons will pivot, and hence travel, to the same extent around the second rotational axis 132, the volume of the chambers 134*a*, 134*b* and swept volume of the pistons 122*a*, 122*b* will differ.

The different volumes may be achieved by providing the second chamber 134*b* as wider than the first chamber 134*a*, with the second piston 122*b* consequentially being wider than the first piston 122*a*.

Hence although the pistons will pivot, and hence travel, to the same extent around the second rotational axis 132, the volume of the second chamber 134*b* will be greater than the volume of the first chamber 134*a*, and hence the swept volume of the piston 122*b* will be greater than piston 122*a*.

Since the first fluid flow section 111 (in this example a displacement/compressor/pump section) and second fluid flow section 115 (in this example a metering/expansion section) are two sides of the same rotor, the rotation of the rotor 119 is driven both by the motor and the metering/expansion of the fluid in the second chamber 134*b* (i.e. in sub-chambers 134*b*1, 134*b*2).

Operation of the device 1000 will now be described.

Stage 1

In the example shown in FIG. 25, the working fluid (for example air) enters the sub-chamber 134*a*1 via the first port 114*a*.

The working fluid is then displaced/compressed/metered by the action of the piston 122*a*, driven by the magnetic coupling of the first magnetic guide feature 52 and the second magnetic guide feature 50 and the expansion of working fluid in the second chamber 134*b* (described below in stage 3), and exits via the second port 114*b*.

At the same time as working fluid is being drawn into the sub-chamber 134*a*1, working fluid is being exhausted from sub-chamber 134*a*2 through the second port 114*b*.

At the same time as working fluid is being exhausted from the sub-chamber 134*a*2, working fluid is being drawn into sub-chamber 134*a*1 through the first port 114*a*.

Stage 2

In the example as shown in FIG. 25, the working fluid then travels from the first chamber 134*a* along duct 300*a*1 and enters the first heat exchanger 302*a*, which is configured as a heat source. Hence heat is added to the working fluid as it passes through the first heat exchanger 302*a*.

A substance, such as air, gas or liquid may also be passed through the heat exchanger 302*a*, via a separate inlet and acts to transfer heat to the working fluid. Put another way, a substance enters the heat exchanger 302*a* at a first temperature and leaves the heat exchanger at a second temperature, wherein the second temperature is lower than the first temperature. The heat from the substance is transferred to the working fluid. Hence the working fluid absorbs heat from the heat source (for example, the substance) and then leaves the first heat exchanger 302*a* and travels along duct 300*a*2 before entering the second chamber 134*b*.

Stage 3

In the example as shown in FIG. 25 the working fluid exits the first heat exchanger 302*a* via the duct 300*a*2. The pressure of the working fluid is held at a relatively low pressure in the duct 300*a*2, for example below atmospheric pressure.

The working fluid travels along duct 300*a*2 and enters the sub-chamber 134*b*1 of the rotor via the third port 116*a* and the working fluid is expanded.

At the same time as working fluid is entering and expanding in the sub-chamber 134*b*1, working fluid is being exhausted from sub-chamber 134*b*2 via the fourth port 116*b*.

As the rotor 119 continues to rotate, the working fluid is exhausted from the sub-chamber 134*b*2 via the fourth port 116*b*, and more working fluid enters the sub-chamber 134*b*1 via the third port 116*a* where it expands.

Hence the exhaust gas expands sequentially in the sub-chambers 134*b*1, 134*b*2 of the second chamber 134*b* (hence the fluid decreases in pressure and increases in volume). In one example, this expansion results in a negative pressure being maintained in the duct 300*a*, which in turn contributes to driving the first piston 122*a* across chamber 134*a* introducing a further portion of air to start the process again. The expansion of the exhaust gas in sub-chambers 134*b*1, 134*b*2 may result in work being done by the fluid on the second piston 122*b* to urge the first piston 122*b* across the chamber 134*b* (operating as an expansion chamber), which drives the first piston 122*a* across the first chamber 134*a* to draw in and compress a further portion of air to start the process again.

Hence the sequential expansion of the working fluid in the rotor sub-chambers 134*b*1, 134*b*2 induces a force to thereby cause pivoting of the rotor about its second rotational axis 132, and to cause rotation of the rotor about its first rotational axis 130. This rotational force is in addition to the force provided by the motor 308.

Hence, the system shown in FIG. 25 is operable to work as an air source cold pump.

In use, the system of FIG. 25 is reversible such that if the direction of the rotation of the first shaft portion 118 is reversed, a positive pressure difference is created between the second fluid flow section 115 and the first fluid flow section 111. In this example, the heat exchanger 302 extracts heat from the fluid passing therethrough to heat a substance in duct 303. In this example, the system is an air source heat pump. Put another way, the magnetic coupling between the first magnetic guide feature 52 and the second magnetic guide feature 50 is operable to rotate the first shaft portion in a either a first direction or a second direction (i.e. in a clockwise direction or an anti-clockwise direction). When the magnetic coupling between the first magnetic guide feature 52 and the second magnetic guide feature 50 is operable is configured to drive the rotor 119 around the first rotational axis 130 in a first direction, the first heat exchanger 302*a* is operable to act as a heat source to transfer heat from the substance to the fluid.

As the system is reversible, when the magnetic coupling between the first magnetic guide feature 52 and the second magnetic guide feature 50 is operable is configured to drive the rotor 119 around the first rotational axis 130 in a second direction, opposite to the first direction, the first heat exchanger 302*a* is operable to act as a heat source to transfer heat from the fluid to the substance. In this example, the system to operable to work as an air source heat pump.

In each of the examples provided above, at least one of the first magnetic guide feature 52 and second magnetic guide feature 50 comprises an electro-magnet operable to magnetically couple to the other of the first magnetic guide feature 52 and second magnetic guide feature 50 to pivot the rotor 16 thereby inducing the rotor 16 to pivot about the axle 20 relative to the first piston member 22.

In some examples, both the first magnetic guide feature 52 and the second magnetic guide feature 50 comprise electro-magnets. In another, the first magnetic guide feature 52 comprises one or more permanent magnets and the second magnetic guide feature 50 comprises one or more electro-magnets. In another example, the second magnetic guide feature 50 comprises one or more permanent magnets and the first magnetic guide feature 52 comprises one or more electro-magnets.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. An apparatus comprising:

a shaft which defines and is rotatable about a first rotational axis;

an axle defining a second rotational axis, the shaft extending through the axle;

a first piston member provided on the shaft, the first piston member extending from the axle towards a distal end of the shaft;

a rotor carried on the axle;

the rotor comprising a first chamber, the first piston member extending across the first chamber;

a housing having a wall which defines a cavity, the rotor being rotatable and pivotable within the cavity;

a first magnetic guide feature coupled to the rotor;

a second magnetic guide feature coupled to the housing;

the rotor and axle are rotatable with the shaft around the first rotational axis;

the rotor is pivotable about the axle about the second rotational axis to permit relative pivoting motion between the rotor and the first piston member as the rotor rotates about the first rotational axis; and at least one of the first magnetic guide feature and second magnetic guide feature comprises an electro-magnet operable to magnetically couple to the other of the first magnetic guide feature and second magnetic guide feature to pivot the rotor thereby inducing the rotor to pivot about the axle relative to the first piston member.

2. The apparatus as claimed in claim 1 wherein the first chamber has a first opening, and the first piston member extends from the axle across the first chamber towards the first opening.

3. The apparatus as claimed in claim 1 wherein:

the first piston member extends from one side of the axle along the shaft, and a second piston member extends from the other side of the axle along the shaft, wherein the rotor comprising a second chamber to permit relative pivoting motion between the rotor and the second piston member as the rotor rotates about the first rotational axis.

4. The apparatus as claimed in claim 3 wherein:

the second chamber has a second opening, and the second piston member extends from the axle across the second chamber towards the second opening.

5. The apparatus as claimed in claim 3 wherein the shaft, the axle and one or both of the first and second piston members are fixed relative to one another.

6. The apparatus as claimed in claim 1 wherein the magnetic coupling between the first magnetic guide feature and second magnetic guide feature drives the rotation of the shaft about the first rotational axis.

7. The apparatus as claimed in claim 1 wherein the first magnetic guide feature comprises at least one permanent magnet.

8. The apparatus as claimed in claim 7 wherein the first magnetic guide feature comprises two diametrically opposed permanent magnets arranged on the rotor.

9. The apparatus as claimed in claim 7 wherein the first magnetic guide feature comprises one or more clusters of permanent magnets arranged on the rotor.

10. The apparatus as claimed in claim 1 wherein the first magnetic guide feature is configured to be received in one or more recesses in the rotor.

11. The apparatus as claimed in claim 1 wherein the first magnetic guide feature comprises:

a slewing ring, and a plurality of magnets arranged on an outside of the slewing ring, wherein the slewing ring is configured to be coupled to the rotor via an engagement fixture.

12. The apparatus as claimed in claim 11 wherein the engagement fixture comprises a pivot pin to enable the first magnetic guide feature to pivot relative to the rotor.

13. The apparatus as claimed in claim 1 wherein the second magnetic guide feature comprises a plurality of electro-magnets.

14. The apparatus as claimed in claim 13 wherein the second magnetic guide feature comprises a spacer ring and the plurality of electro-magnets are arranged on an inside surface of the spacer ring.

15. The apparatus as claimed in claim 13 wherein the plurality of electro-magnets are arranged in an array on the inside of the housing.

16. The apparatus as claimed in claim 13 wherein the apparatus is configured to control the polarity of the plurality of electro-magnets of the second magnetic guide feature.

17. The apparatus as claimed in claim 1 wherein the magnetic coupling of the second magnetic guide feature and the first magnetic guide feature is configured to provide a guide path around a first circumference of the rotor or housing.

18. The apparatus as claimed in claim 17 wherein the guide path comprises at least:

a first inflexion which directs the guide path away from a first side of the first circumference and then back toward a second side of the first circumference, and a second inflexion which directs the guide path away from the second side of the first circumference and then back toward the first side of the first circumference.

19. The apparatus as claimed in claim 1 further comprising:

a first fluid flow section, a first port and second port provided in a wall of the housing and each in flow communication with the first chamber, and a second fluid flow section comprising, a second chamber, a second housing wall adjacent the second chamber, a third port and a fourth port provided in the second housing wall and each in flow communication with the second chamber, the second fluid flow section is configured for the passage of fluid between the third port and fourth port via the second chamber;

the second port being in fluid communication with the third port via a first heat exchanger.

20. The apparatus as claimed in claim 19 wherein:

the rotor is a first rotor, the first rotor comprises the second chamber, the first piston member extends from one side of the first axle along the first shaft portion, and a second piston member extends from the other side of the first axle along the first shaft portion, across the second chamber to permit the first rotor to pivot relative to the second piston member as the first rotor rotates about the first rotational axis, and the fourth port is in fluid communication with the first port via a second heat exchanger.

21. The apparatus as claimed in claim 20 further comprising:

a second rotor comprising the second chamber, a second shaft portion rotatable about the first rotational axis, and the second shaft portion is coupled to the first shaft portion such that the first shaft portion and second shaft portion are rotatable together around the first rotational axis, a second axle defining a third rotational axis, the second shaft portion extending through the second axle, a second piston member provided on the second shaft portion, the second piston member extending from the second axle towards a distal end of the second shaft portion, the second rotor carried on the second axle, the second piston member extending across the second chamber, the second rotor and second axle are rotatable with the second shaft portion around the first rotational axis, and the second rotor is pivotable about the second axle about the third rotational axis to permit the second rotor to pivot relative to the second piston member as the second rotor rotates about the second rotational axis.

22. The apparatus as claimed in claim 21 wherein:

the first rotor comprises:

a first rotor second chamber, the first piston member extending from one side of the first axle along the first shaft portion; and a second piston member extends from the other side of the first axle along the first shaft portion, across the first rotor second chamber to permit the first rotor to pivot relative to the second piston member as the first rotor rotates about the first rotational axis; and the second rotor comprises:

a second rotor first chamber the second piston member extends from one side of the second axle along the second shaft portion; and a second rotor first piston member extends from the other side of the second axle along the second shaft portion, across the second rotor first chamber to permit the second rotor to pivot relative to the second rotor first piston member as the second rotor rotates about the first rotational axis;

the first rotor second chamber is in flow communication with a fifth port and a sixth port to thereby form part of the first fluid flow section, and configured for the passage of fluid between the fifth port and sixth port via the first rotor second chamber;

the second rotor first chamber is in flow communication with a seventh port and an eighth port to thereby form part of the second fluid flow section, and configured for the passage of fluid between the seventh port and eighth port via the second rotor second chamber, wherein the sixth port is in fluid communication with the seventh port via the first heat exchanger.

23. The apparatus as claimed in claim 22 wherein the eight port is in fluid communication with the fifth port via a second heat exchanger.

24. The apparatus as claimed in claim 23 wherein the fourth port is in fluid communication with the first port via the second heat exchanger.

25. The apparatus as claimed in claim 19 wherein the first heat exchanger is operable as a heat sink to remove heat energy from fluid passing through it.

26. The apparatus as claimed in claim 19 wherein the first heat exchanger is operable as a heat source to add heat energy to fluid passing through it.

27. The apparatus as claimed in claim 26 wherein the heat source comprises a substance passing through a duct in the first heat exchanger, wherein the apparatus provides cooling to the substance.

28. The apparatus as claimed in claim 27 wherein the fluid comprises air.

29. The apparatus as claimed in claim 6 wherein the magnetic coupling between the first magnetic guide feature and the second magnetic guide feature is operable to rotate the first shaft portion in a either a first direction or a second direction such that when the magnetic coupling is configured to drive the rotor around the first rotational axis in a first direction, the first heat exchanger is operable to act as a heat source to transfer heat from the substance to the fluid, and wherein when the magnetic coupling is configured to drive the rotor around the first rotational axis in a second direction, opposite to the first direction, the first heat exchanger is operable to act as a heat sink to transfer heat from the fluid to the substance.

* * * * *